US006851718B2

(12) United States Patent
Liener Chin et al.

(10) Patent No.: US 6,851,718 B2
(45) Date of Patent: Feb. 8, 2005

(54) PRINTED SHEET PROTECTOR SYSTEM AND METHOD

(75) Inventors: MaryBeth Liener Chin, Huntington, CA (US); Galen C. Wong, South Pasadena, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/686,023

(22) Filed: Oct. 14, 2003

(65) Prior Publication Data

US 2004/0150214 A1 Aug. 5, 2004

Related U.S. Application Data

(63) Continuation of application No. 09/613,639, filed on Jul. 11, 2000, now Pat. No. 6,632,042.

(51) Int. Cl.[7] ..... B42F 21/00

(52) U.S. Cl. ..... 283/36; 40/359; 40/360; 40/641; 206/232; 229/68.1; 229/71; 283/38; 283/42; 402/73; 402/80 R; D19/26; D19/33

(58) Field of Search ..... 283/36–42, 115, 283/116; 229/68.1, 71, 72, 75; 206/232; 281/29; 40/359, 360, 626, 641; 402/70, 73, 79, 80 R, 80 P, 502; D19/3, 26, 27, 33

(56) References Cited

U.S. PATENT DOCUMENTS 1,492,932 A 5/1924 Orrell
3,492,743 A 2/1970 Schmidt
3,710,457 A 1/1973 Rechdahl et al.
3,807,069 A 4/1974 Daley (List continued on next page.)

*Primary Examiner*—Monica S. Carter
(74) *Attorney, Agent, or Firm*—Squire, Sanders & Dempsey LLP

(57) ABSTRACT

In addition to a set of dividers having staggered tabs and binder holes, the retail packaging includes a sheet protector pocket having a front sheet and a back sheet and binder holes. The user removes the dividers and pocket from the packaging and custom designs and prints sheet indicia on a paper sheet. He/she then inserts the printed sheet into the pocket whereby the front sheet allows the sheet indicia to be viewed therethrough. The front sheet has pre-printed indicia thereon. With the printed sheet in the pocket and the pocket and dividers assembled in a ringed notebook or other binding system, the sheet indicia and the pre-printed indicia line up with respective ones of the tabs. The indicia thereby form an attractive custom-designed table of contents, which can be easily corrected or changed by the user by simply printing and inserting into the pocket a new sheet. The front sheet can either be transparent or have a window to allow the sheet indicia to be viewed therethrough. An alternative provides the pre-printed or custom-printed indicia on a separate transparent sheet which is inserted in the pocket in front of the printed sheet. Another invention is a pocket assembly having front and back sheets and binder holes and compartments for inserting therein one or more photographs, other images or the like, which can be viewed through the transparent front sheet. Pre-printed framing designs on the front sheet attractively encircle the photographs.

139 Claims, 15 Drawing Sheets

U.S. PATENT DOCUMENTS 4,334,771 A 6/1982 Ryan, Jr.
4,516,871 A 5/1985 Leitman
4,573,821 A 3/1986 Gilreath
4,784,508 A 11/1988 Shannon
4,832,373 A 5/1989 Swan
4,973,086 A 11/1990 Donnelly et al.
5,011,191 A 4/1991 Gannon et al.
5,056,825 A 10/1991 Templet
5,217,259 A 6/1993 Wilen
5,265,359 A 11/1993 Glazer et al.
5,409,753 A 4/1995 Perez
5,445,417 A 8/1995 Bromer et al.
5,503,435 A 4/1996 Kline
5,543,010 A 8/1996 Keng
5,639,172 A 6/1997 Erickson
5,709,410 A 1/1998 Reeves, Jr.
5,746,451 A 5/1998 Weyer
5,788,283 A 8/1998 Adler
5,795,089 A 8/1998 Ong
5,875,579 A 3/1999 Winzen
5,882,038 A 3/1999 Ong
5,908,259 A 6/1999 Johnson
5,909,979 A 6/1999 Winzen
5,924,812 A 7/1999 Goldman
6,012,866 A 1/2000 Podosek
6,071,030 A 6/2000 Hunter et al.
6,106,018 A 8/2000 McKeown et al.
6,632,042 B1 * 10/2003 Liener Chin et al. ..... 402/79

* cited by examiner

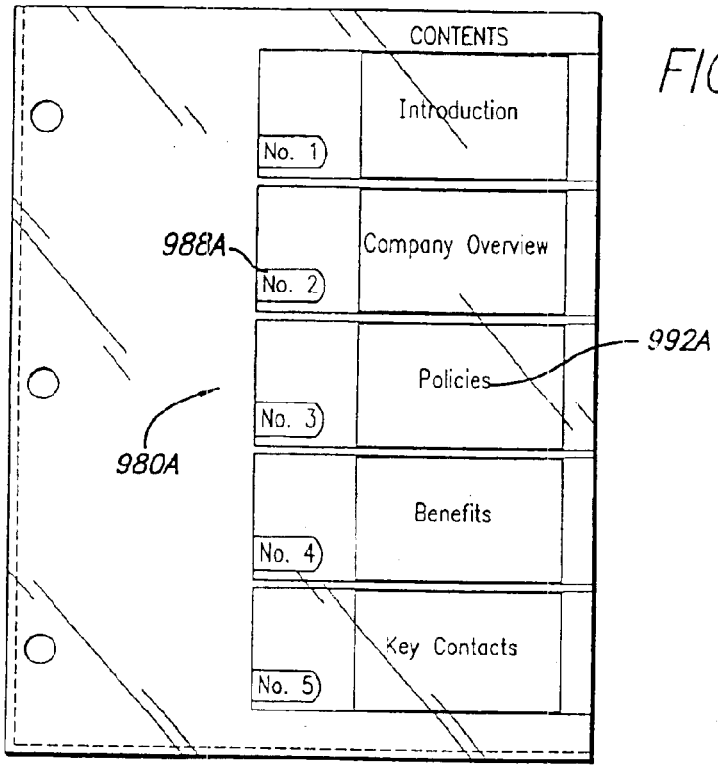
FIG. 27A
FIG. 27B
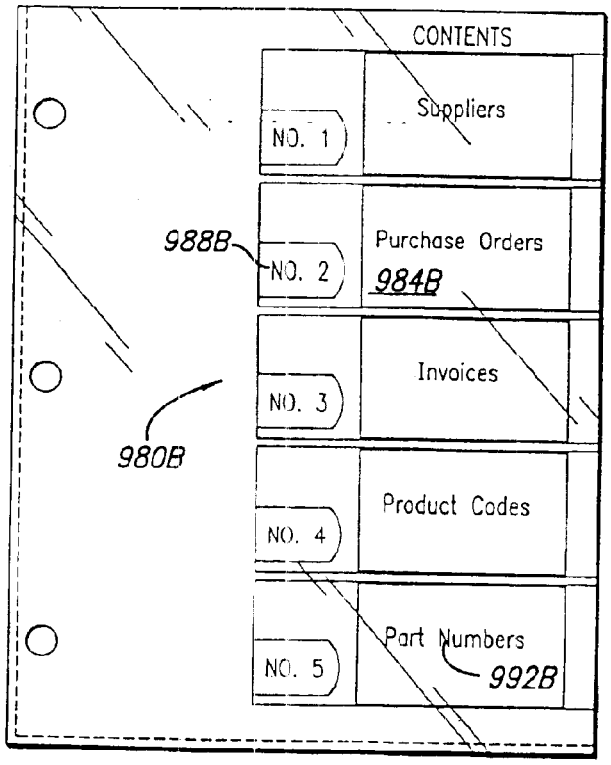

PRINTED SHEET PROTECTOR SYSTEM AND METHOD

CROSS REFERENCE TO RELATED APPLICATION

This is continuation application of U.S. patent application Ser. No. 09/613,639, filed Jul. 11, 2000, and which issued as U.S. Pat. No. 6,632,042 on Oct. 14, 2003, whose entire contents are hereby incorporated by reference.

BACKGROUND OF THE INVENTION

The present invention is directed to systems, apparatuses and methods for protecting, storing, organizing and/or displaying printed sheets, photographs, clippings from periodicals, handwritten pages, drawings and so forth. As an example, the invention is concerned with user-customizable ring binder indexing systems. Further examples are user-customizable sheet protector apparatuses and particularly those which are at least partially transparent so that their sheet contents can be viewed and those which have binder ring holes.

A number of protecting and organizing systems are known in the prior art. One example is shown in FIG. 1 and referring thereto, a prior art system shown generally at 100 is the READY INDEX—CONTEMPORARY TABLE OF CONTENTS—DIVIDERS PRODUCT available from Avery Dennison Corporation of Pasadena, Calif., and illustrated assembled in a three ring binder 104 with the user's document pages 108 filed therein. The system 100 is sold in a package that includes the table of contents page 112 and a set of tabbed dividers 116. The illustrated prior art embodiment includes a five tab set, but the product is also available in an eight tab set, as well as ten, twelve and fifteen months, A-Z, and 1–31 tab sets. Each of the tabs 120 of the tabbed dividers 116 may have a sequential number 124 pre-printed thereon, and each tab can be colored with a different color (e.g., yellow, orange, red, magenta and purple).

The table of contents page 112 has a series of pre-printed fields, one above the other, and abutting the right edge. Each of the fields is aligned with a separate tab 120, when the table of contents page 112 is aligned or stacked with the dividers 116, such as when filed in a ring binder 104 through the binder holes 124 in the table of contents page 112 and each of the tabbed dividers, as illustrated in FIG. 1. Each of the fields has a central block 128, a right edge strip 132, a connecting horizontal line 136 and a (blank) block 140 between the central block and the strip and above the line. The central block 128 and the strip 132 are printed or formed with the same color (e.g., yellow, orange, etc.) as the color of the corresponding (adjacent, aligned) tab 120. And the same number 142 (e.g., 1, 2, 3, 4 or 5) as the number 124 on the corresponding tab 120 is pre-printed in the central block 128.

The user, after removing the table of contents page 112, dividers and instruction sheet (not shown), from the retail packaging follows the instructions on the instruction sheet to custom design or format the page on his/her personal computer using existing software. For example, he/she can use preset layouts in existing software such as MICROSOFT WORD FOR WINDOWS, COREL WORDPERFECT FOR WINDOWS, COREL WORDPERFECT FOR DOS, LOTUS WORD PRO AND LOTUS AMI PRO, following the instructions in the instruction sheet, such as the QUICK START!, copyright 1998, instruction sheet. (The entire contents of this instruction sheet publication and all other publications and patents and applications mentioned anywhere in this disclosure are hereby incorporated by reference.) The user thereby designs the section titles 144. (The user can also put titles in the table of contents via typewriter, labels and handwriting.)

The user then prints the titles 144 onto the table of contents page 112 using a laser or ink jet printer or copier. He/she then assembles the document using the custom-printed table of contents page 112, matching pre-printed tabs 120, and document pages into the three ring binder 104 to form system 100. A problem with system 100 is that only a single table of contents page 112 is provided in the package, and thus if the user or the printer makes a mistake in formatting or printing the titles or if the user changes his mind as to the desired titles, another package having another table of contents page must be purchased. In other words and more specifically—the table of contents page 112 can rip, get dirty or wrinkled and thus some consumers find them to not be sufficiently durable; the page has a specific orientation requiring that the user load it in the printer in a specific direction, with printing errors resulting if it is not loaded properly; and since only one page is provided in a package, a printing error essentially ruins the entire packaged set.

Another prior art custom-designed table of contents sheet system (not illustrated in the drawings) is disclosed in U.S. Pat. No. 5,503,435 (Kline). Pursuant to the '435 patented system, first and second tabbed index sheets and a table of contents page are provided. First and second labels are releasably attached to the front of the table of contents page generally adjacent to but spaced from descriptive field areas on the page. The page is passed through a printer or copier, and custom indicia are printed on the labels and in the field areas in the same printing operation. The labels are then removed by the user and attached by their adhesive backings to the respective tabs. The labels before printing are adhered directly to the page inward of the descriptive field areas, to a removable carrier strip, which is adhered to the front of the page or to a tear-away strip at the bottom of the page. This system does not have the flexibility in construction and is a little more labor intensive than some users desire.

Another prior art divider apparatus is illustrated in FIG. 2, generally at 200, and is commercially available as the CLIP AND CREATE VIEW DIVIDERS product from the Avery Dennison Corporation. This apparatus 200 includes a clear plastic pocket 204 having an open top 208, a binder strip 212 with binder holes 216 along its left edge and a tab 218, which extends out from the right edge and has an open top 224. Provided in the retail package in addition to a set of these pocket apparatuses, is a sheet (not shown) having a strip of perforated tab inserts and printed instructions. The titles 228 for the tabs 220 are formatted using templates available in many different software programs. The tab title words, fonts and margins are selected by the user on his/her personal computer using the program. The tab sheet is loaded into the manual feed tray of the user's printer, and the tab inserts 220 are printed. The printed inserts 220 are separated from each other and the surrounding sheet along the perimeter perforations. The separated, printed tab inserts 220 and then folded and inserted into the tab holders through the open tops 224, as show by the arrow 234 in FIG. 2.

The desired sheet material 240, such as printed or handwritten sheets, photographs, clippings, and so forth, are inserted into the pocket 204 through the open top 208 and are visible through the clear front panel 244 of the pocket. The tab title 228 can be a descriptor of the inserted material 240 or can be a sequential indicia (such as numbers, months, etc.). The pocket apparatus 200, together with other pockets, can be inserted into a three ring binder, such as that shown in FIG. 1 at 104. Although this product is useful in, for example, personalizing school subjects and memory books, it does not provide for a table of contents sheet or other means of personalizing, decorating, indexing or labeling the pocket contents (240).

SUMMARY OF THE INVENTION

Directed to remedying the deficiencies in the prior art, the present invention has many forms and embodiments including the overall system, the apparatus component and the method of use. One feature of the present invention is a sheet protector that includes a clear or translucent plastic sleeve or a translucent or opaque plastic or paper envelope with one or more windows through which the contents of the sleeve can be viewed. The sheet protector is printed to enhance it and/or its content's functionality and/or attractiveness. The sheet protector may exist in many forms as discussed below. The sheet protector may be printed with a decorative element on one or both sides with the design element to coordinate with its contents or with other items assembled or bound therewith, such as index dividers.

Another definition of the present invention uses a clear view table of contents sheet or page with a set of dividers. The sheet includes a sleeve made of plastic and/or paper that has coordinating tab colors and/or numbers printed on selected areas of the protector. The consumer uses standard READY INDEX SOFTWARE templates to lay out the tab titles on the page. He/she prints custom-formatted tab titles on a plain piece of paper, for example, and then inserts the printed paper into the sleeve. Thereby, the tab titles can be seen through the clear plastic front sheet of the sleeve. This table of contents sleeve provides durability and protection to the printed table of contents sheet. Another benefit of this embodiment is the consumer can print the titles on plain paper and if an error is made or if a change is desired, it can easily be corrected or changed by printing another sheet of plain paper and inserting it into the sleeve.

A further embodiment is to provide a printed sheet protector that is used as a photo page. The printed portion acts as a frame around each photo, bordering the photograph. The printing alternatively or additionally can be used as decorative elements to enhance the photograph. The sheet protector may have small compartments or windows into which individual photographs are inserted, or it may have a single large section to be used for a collage of photographs or a single large photograph. Additionally, the printed portion may have a special surface on which dates or journals to describe the photographs or contents, using writable inks or the like, can be written by the user. The printed portions can be decorated with themes of popular photographed events, such as holidays, weddings, birthdays, babies, sporting events and so forth. Instead of photographs, other visual sheets can be used, such as drawings, artwork, cover sheets for reports and so forth. As an example, it may be used by a parent to decoratively frame and protect his/her children's early handprints or artwork.

A further embodiment includes the sheet protector sold to the consumer with an inkjet receptive coating that allows the consumer to print his/her own designs directly onto the sheet protector using his/her inkjet printer.

Another embodiment has the sheet protector packaged with a transparent insert that is printed with the functional or decorative elements previously described. The transparent insert is to be placed by the consumer inside the sheet protector followed by a sheet of paper which has been printed with the desired indicia by the consumer. The insert is preferably the same size as the sheet of paper. And the resulting product is a printed or preprinted sheet protector.

Another embodiment includes the sheet protector packaged with a transparent insert that has an inkjet/laser receptive coating. This allows the transparent insert to be designed and printed by the consumer with the design(s) of his/her choice. The consumer then inserts the printed transparent insert into the sheet protector, followed (or preceded) by a sheet printed by the consumer. The results is a custom-printed sheet protector, designed entirely by the consumer.

A further embodiment provides the set of dividers made from clear or transparent plastic having colored, numbered or otherwise indicia-identified tabs. The table of contents design is printed on the body of the first divider. The consumer uses standard READY INDEX software templates (or similar software) to print tab titles on a plain sheet of paper, which is placed in the binder or report cover behind the first divider. The tab titles are viewable through the clear or transparent body of the first divider surrounded by the appropriate design which is preprinted on the divider body. The page can be attached to the divider if desired, such as by a self-adhesive strip.

A still further embodiment of the present invention includes a lamination pouch that is preprinted with a decorative or functional design into which a consumer places a printed sheet, or photos and laminates by means of thermal lamination or pressure-sensitive adhesive. Again, the printing on the pouch can alternatively be done by the consumer with the pouch being provided with a suitable inkjet or a blank receptive coating.

A yet still further embodiment uses a single sheet lamination overlay printed with decorative or functional designs beneath which the consumer places a printed sheet or photos and laminates by thermal lamination or pressure sensitive adhesive.

Another embodiment includes a protector pocket having a tab divider extending out therefrom. The user prepares a sheet with indicia thereon and inserts the sheet in the pocket into a viewing position. The front sheet of the pocket preferably has pre-printed indicia thereon and aligned with the sheet indicia which is viewable through the front sheet with the sheet in the viewing position. At least one of the indicia of the sheet indicia is aligned with at least one of the indicia of the front sheet and with the tab. The other indicia of the sheet and front sheet are aligned with respective tabs of similar tabbed protector pockets when stacked on top of each other. The insert sheets for each tab section can be immediately behind the corresponding tabbed protector pocket, or less desirably inside the pocket and behind the sheet.

Alternatively, one or more decorative elements can be printed on the body of the divider, such as Avery Dennison Corporation's TABBED SHEET PROTECTOR product (such as shown in FIG. 2). The decorative element can be popular licensed artwork, such as the popular POKEMON characters or the SWOOSH logo of the Nike Corporation, or it can be descriptive of the intended contents of the pocket, such as "Geometry Assignments." A variation is to use a one-ply polypropylene divider; an example is the Avery TABBED SHEET PROTECTOR product that is not a pocket, but rather has only one polypropylene layer forming the body and the tab is still an insertable tab. This divider, pursuant to the invention variation, would be printed with one or more decorative or descriptive elements as described above.

The invention allows consumers to print information or designs directly onto the sheet protectors, thereby avoiding tampering with the contents of the sheet protection. This allows consumers to add temporary markings to a document without printing directly on them. Pursuant to another feature herein the consumer can customize the printing on the insert.

A further description of the invention is a system that allows consumers to print the table of contents page on a plain sheet of paper and view the tab titles through a transparent or translucent body of the divider which being formed of plastic and disposed in front of it, protects it. The paper sheet may be loose or attached to the divider by means of a self adhesive strip on the back side of the divider, or notches in the divider which hold the sheet, or clips on the back side of the divider. When the printed page is adhered to the divider page, the first page of the document will preferably not be the table of contents page.

In other words, disclosed herein is a sheet protector, which includes a clear or translucent plastic sleeve or a paper or translucent or opaque plastic envelope with windows through when the sleeve contents can be viewed. The sheet protector is printed to enhance the functionality and/or attractiveness of its contents or the sheet protector itself. The following are examples of some of the forms of the sheet protector:

(1) A sheet protector that is printed with a decorative element on one or both sides with a design element to coordinate with other document handling items, such as three ring binders, report covers and dividers.

(2) A clear view table of contents sheet used with a set of dividers; it is a sleeve made of plastic and/or paper, for example, which has the coordinating tab colors printed on selected areas of the sheet protector. The consumer uses commercially available READY INDEX software templates to lay out the tab titles on the page. He/she prints a plain piece of paper with the tab titles and inserts the printed plain paper into the sleeve whereby the tab titles can be seen through the clear plastic. This table of contents sleeve provides durability and protection to the printed title sheet. Another consumer benefit is the ability to print the titles on a plain sheet of paper; thus, if there is an error, it can be easily rectified by printing another sheet of plain paper and inserting it into the sleeve.

(3) A printed sheet protector used as a photo page with the printed portion acting as a frame around each photo, bordering the photograph. Instead of defining a frame, the printing can be used as decorative elements to enhance the photographs. The sheet protector can have small compartments to slide individual photographs or larger sections for a collage of or a large photograph. The printed portion may also include a space having a surface on which the user can write with writeable inks dates or journaling to describe the photograph or contents. The printed portions can be decorated with themes of commonly photographed events, such as holidays, weddings, birthdays, sporting events and babies.

(4) The sheet protector is printed with an ink jet receptive coating that allows the consumer to print his own designs directly onto the sheet protector using his/her ink jet printer.

(5) A sheet protector is provided (packaged) with a transparent insert that is printed with the above-described functional and/or decorative elements. The insert is to be placed inside the sheet protector followed by (or with) a sheet of paper which is printed by the consumer. The insert is preferably the same size as the printed sheet of paper. A pre-printed sheet protector is thereby formed.

(6) A sheet protector is packaged with a transparent insert that has an ink jet/laser receptive coating. The insert is designed to be custom formatted and printed by the consumer, and inserted into the sheet protector before, after or with a consumer printed sheet to form a custom designed and printed sheet protector.

(7) A set of dividers is made from clear or translucent plastic having colored, numbered tabs. The table of contents design is printed on the body of the first divider. The consumer uses the READY INDEX software templates, for example, to print tab titles on a plain sheet of paper which is placed in the binder or report cover behind the first divider. The tab titles are seen through the clear or translucent body of the first divider surrounded by the appropriate design which is preprinted on the divider body. The page is preferably attached to the divider, such as with a self-adhesive strip.

(8) A consumer positions a printed sheet or a photograph into a lamination pouch that is preprinted with one or more decorative or functional designs and laminates the assembly using thermal lamination or pressure sensitive adhesive.

(9) A single sheet lamination overlay is printed or preprinted with decorative and/or functional designs and a consumer places a printed sheet or photos underneath the overlay and laminates them together using thermal lamination or pressure sensitive adhesive.

The film or material used for the pockets or protectors can be polypropylene with thicknesses of between 0.0002–0.00050 inch; for example, 0.0002 inch for economy weight, 0.00024 for standard weight, 0.00033 for heavyweight, and 0.00050 for superheavyweight. Aside from polypropylene, polyester, polyethylene and vinyl can be used Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIGS. 27A, 27B, 27C and 27D show different designs for the front sheet of the pocket protectors with the printed titles of inserted title sheets visible in the field blocks thereof.

DETAILED DESCRIPTION OF PREFERRED EMBODIMENTS OF THE INVENTION

Figure 1:
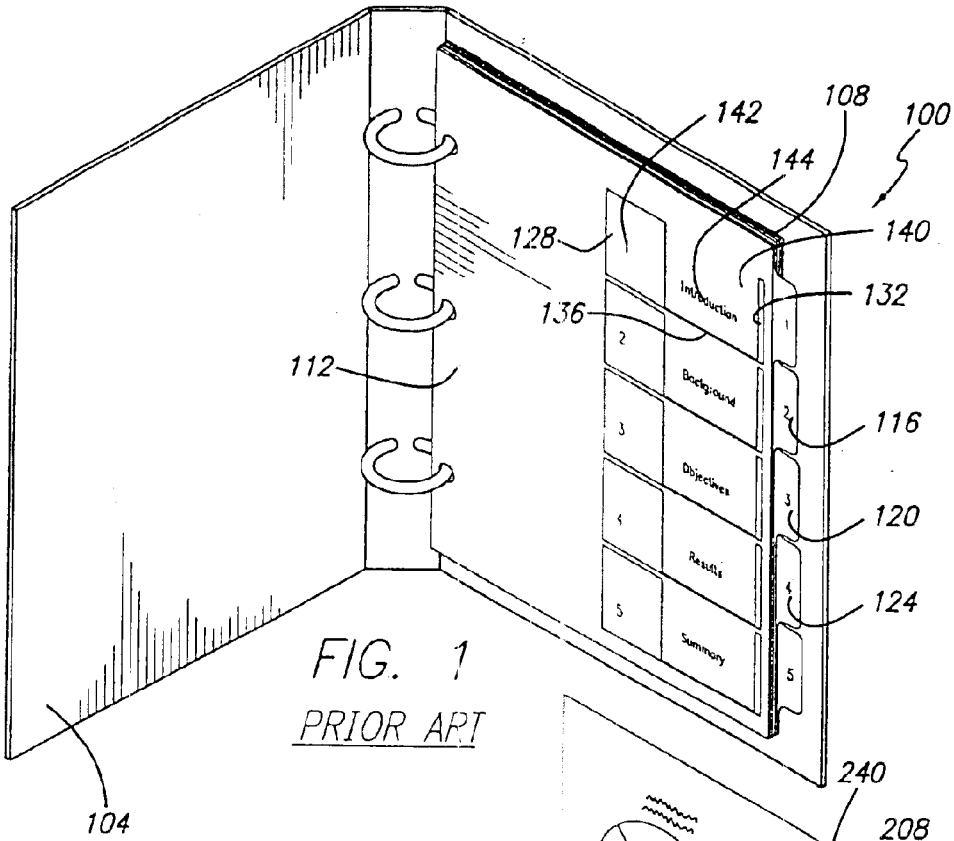
FIG. 1 PRIOR ART
FIG. 1 is a perspective view of a printed table of contents sheet (or page) and divider system of the prior art.
Figure 3:
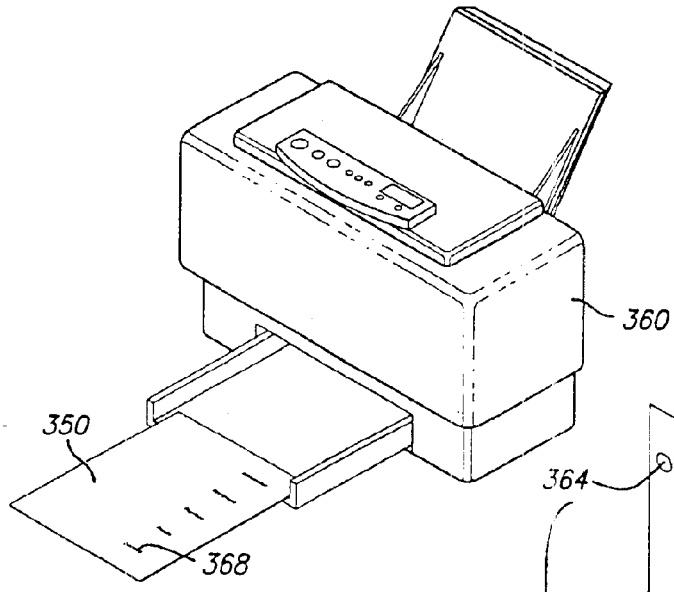
FIG. 3 is a perspective view illustrating a printer printing a (custom designed) table of contents sheet of the present invention.
Figure 4:
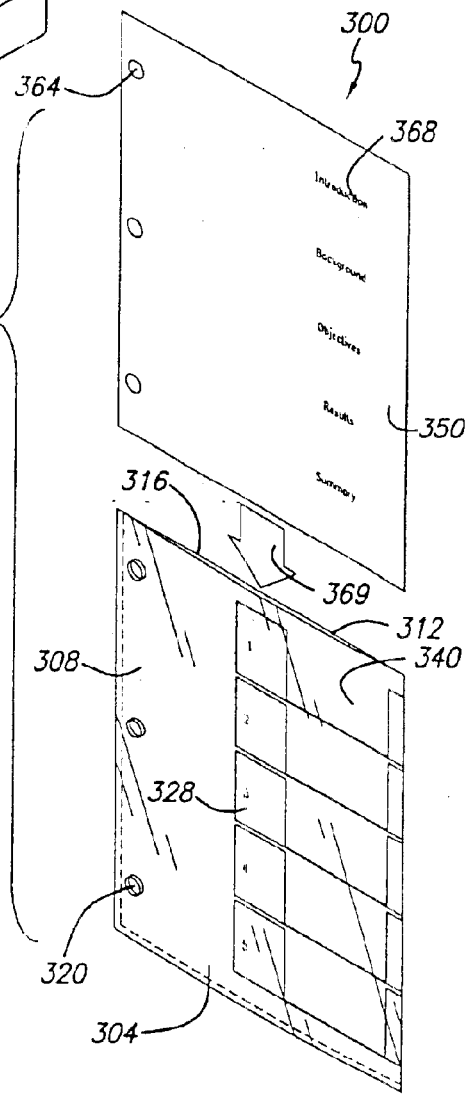
FIG. 4 is a perspective view illustrating the printed sheet of FIG. 3 being inserted into a pre-printed transparent sheet protector pocket to form an apparatus of the present invention.
Figure 5:
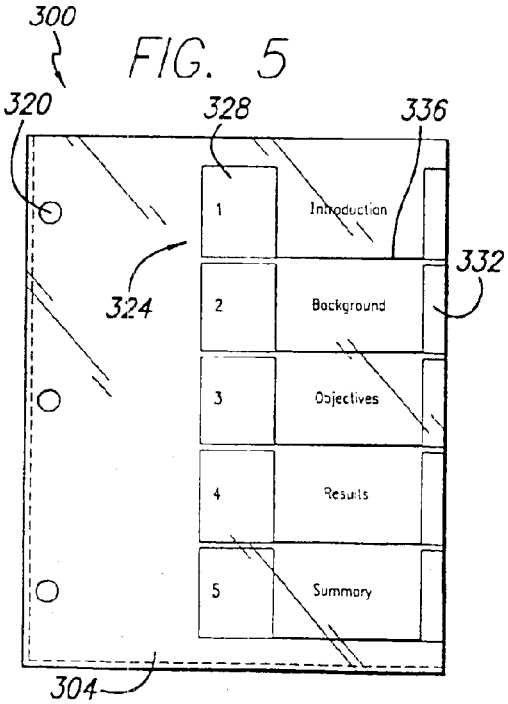
FIG. 5 is a front elevational view of the assembled apparatus of FIG. 4 (which can be used for example with index dividers assembled in a three ring binder similar to the system of FIG. 1)

A first apparatus embodiment of the present invention is illustrated in FIGS. 3–5 generally at 300. Referring thereto, a pocket protector 304 is provided, and construction and printing processes therefor will be described later. Basically, it includes transparent front and back sheets 308, 312 joined to form a pocket having an opening 316, preferably at the top. Ring binder holes 320 are formed along the left edge. And pre-printed on the front sheet are fields 324, similar to those printed on the prior art table of contents page 112 in FIG. 1. As an example, each field includes a central block 328, a right edge strip 332, a connecting horizontal line 336 and a blank block 340 between the central block and the strip and above the line. Each (horizontally) oriented field is aligned with a respective tab of a divider of a set of dividers, such as those shown in FIG. 1, when in a binding system such as the ringed notebook of FIG. 1.

The titles to form this table of contents are (preferably) not printed on the front sheet (with the pre-printed fields). Rather, after the user has selected and formatted them on his personal computer using existing software, he/she prints them out on a sheet of paper 350 using a printer or copier 360, such as is illustrated in FIG. 3. The sheet of paper 350 can be a plain sheet of paper (as illustrated in the drawings) or can have pre-printed material. It can have pre-punched binder holes or the user can punch the binder holes 364 before or after the printing operation. Alternatively, no binder holes can be used where a binder strip is used such as in FIG. 20 or where a ring binder notebook is not to be used. Instead of a ring-binder notebook other binding systems can be used such as tape binding, thermal binding, comb binding, velo binding or staple binding. And these alternative binding systems can be used with generally any of the apparatuses and systems described hereafter.

The titles 368 which are printed on the sheet 350 are spaced and sized such that when the sheet is inserted into the pocket down through the open top 316 as shown by the arrow 369 in FIG. 4 into an inserted viewing position, as illustrated in FIG. 5, the titles 368 will be positioned in the respective blank blocks 340. This will give an appearance for the table of contents similar to the prior art table of contents page of FIG. 1.

There are a number of important differences, however. First, the titles 368 are printed on a plain sheet of paper 350, preferably. Thus, if printing or formatting mistakes are made or if the titles need to be changed, the corrective process is simple and inexpensive—the new or corrected titles are simply printed on another sheet of paper, which is inserted into the pocket. Second, the pocket is sturdy, less likely to tear than the prior art paper table of contents page. Third, it protects the titles so that they are less likely to get smudged or stained, and the pre-printed fields on the transparent sheet are also sturdy.

Figure 6:
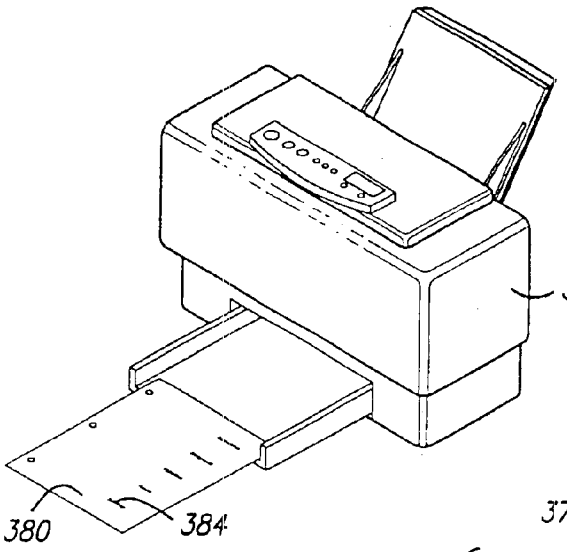
FIG. 6 is a view similar to FIG. 3.
Figure 7:
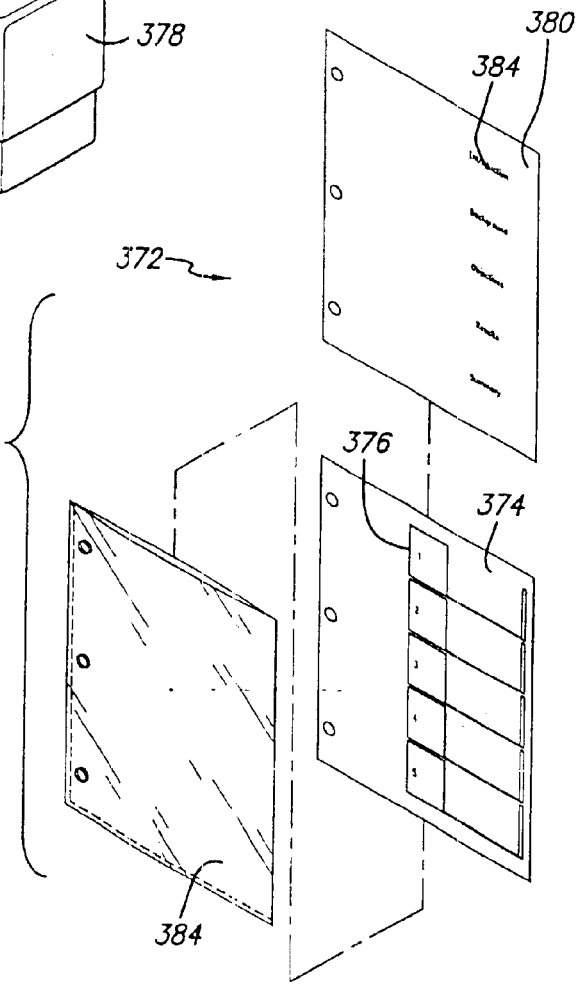
FIG. 7 is a perspective view showing the printed sheet of FIG(S). 6 (or 3) being inserted together with a pre-printed transparent sheet of the invention into a transparent (unprinted) sheet protector pocket to form an assembly of the present invention.
Figure 8:
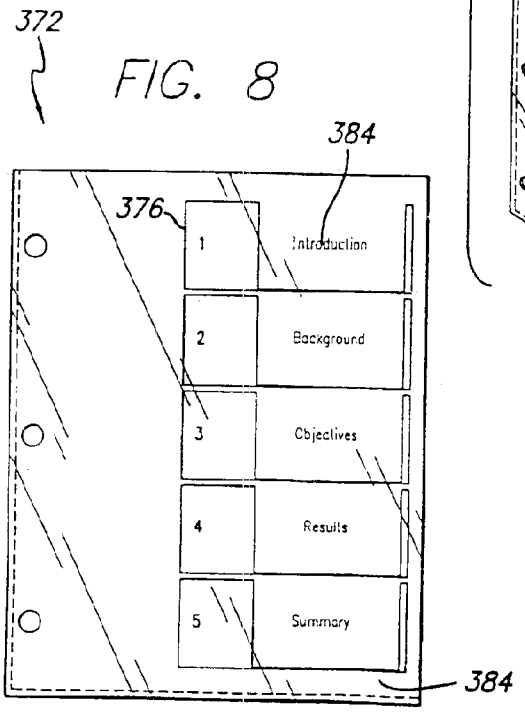
FIG. 8 is a front elevational view of the assembled apparatus of FIG. 7 (which can be used similar to the embodiment of FIG. 5)

A variation of the apparatus of FIGS. 4 and 5 is illustrated by the apparatus 372 in FIGS. 7 and 8. Instead of the front sheet of the pocket apparatus having the field areas pre-printed thereon, a separate transparent sheet 374 with the field areas 376 pre-printed thereon is provided. And then the custom formatted and printed (in the printer or copier 378 of FIG. 6, for example) title sheet 380 with titles 384 is inserted with the pre-printed transparent sheet 370 into the pocket 384 to form the table of contents apparatus, whose assembled front view is illustrated in FIG. 8. An advantage of this apparatus is that a variety of styles of the pre-printed field area sheets can be provided in a single retail package, providing the consumer a choice, but without the extra expense of one or more additional pockets.

Figure 9:
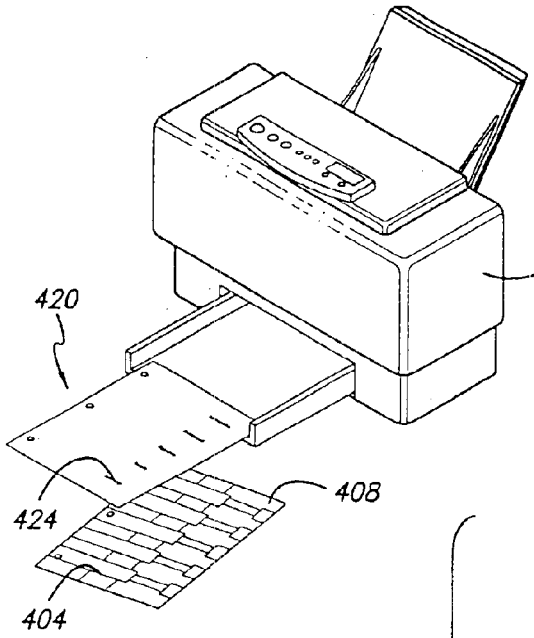
FIG. 9 is a perspective view illustrating a printer custom-printing both a (paper) sheet and a transparent (plastic) sheet of the present invention.
Figure 10:
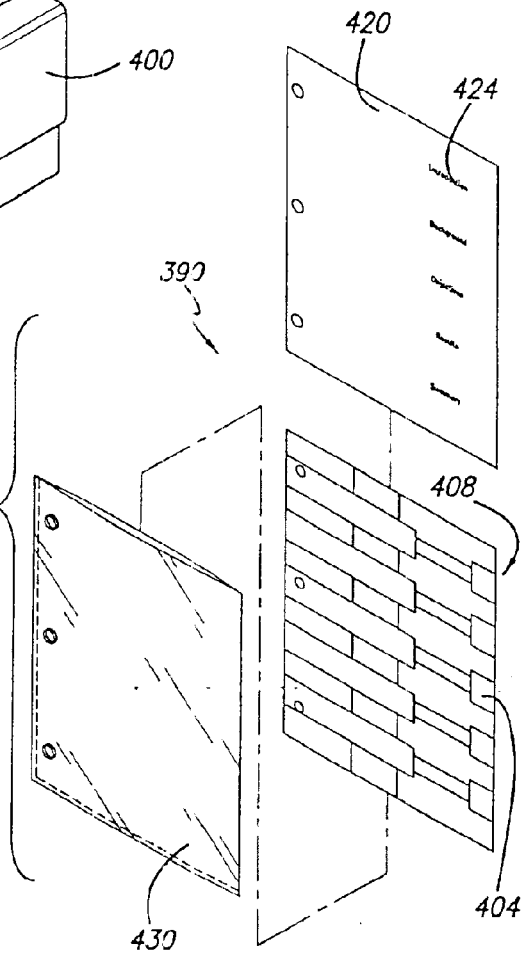
FIG. 10 is a perspective view showing the printed sheet and the printed transparent sheet of FIG. 9 being inserted into a transparent sheet protector pocket to form another assembly of the present invention.
Figure 11:
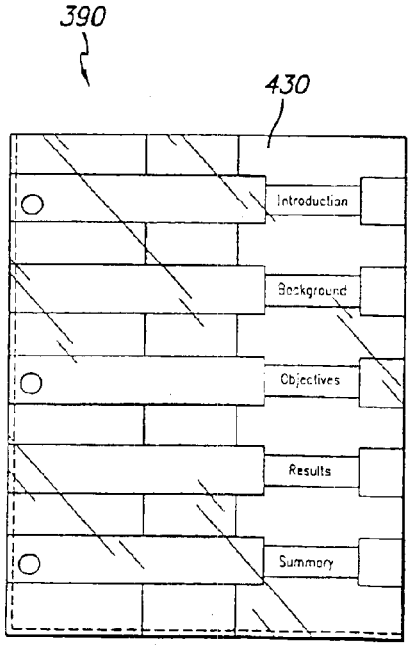
FIG. 11 is a front elevational view of the assembled apparatus of FIG. 10.

A variation of the apparatus of FIGS. 7 and 8 is illustrated in FIGS. 9–11 at 390. Referring thereto, the separate transparent field area sheet is not pre-printed. Rather, the user formats and prints, using the printer or copier 400 of FIG. 9, for example, the field areas 404 on a transparent sheet 408. The transparent sheet 408 can be provided in the product's retail packaging or separately. While a preferred embodiment is to have the sheet provided plain, it alternatively can be partially pre-printed. The FIG. 10 embodiment allows the user to custom format the field areas 408 and to format and print a substitute field area sheet should the need or desire arise. The title sheet 420 printed with titles 424 in printer 400 is positioned behind sheet 408 in transparent pocket 430 as shown in FIG. 11. A less desirable alternative is to print the title page on a transparent sheet and position it in the pocket in front of the field area sheet.

Figure 12:
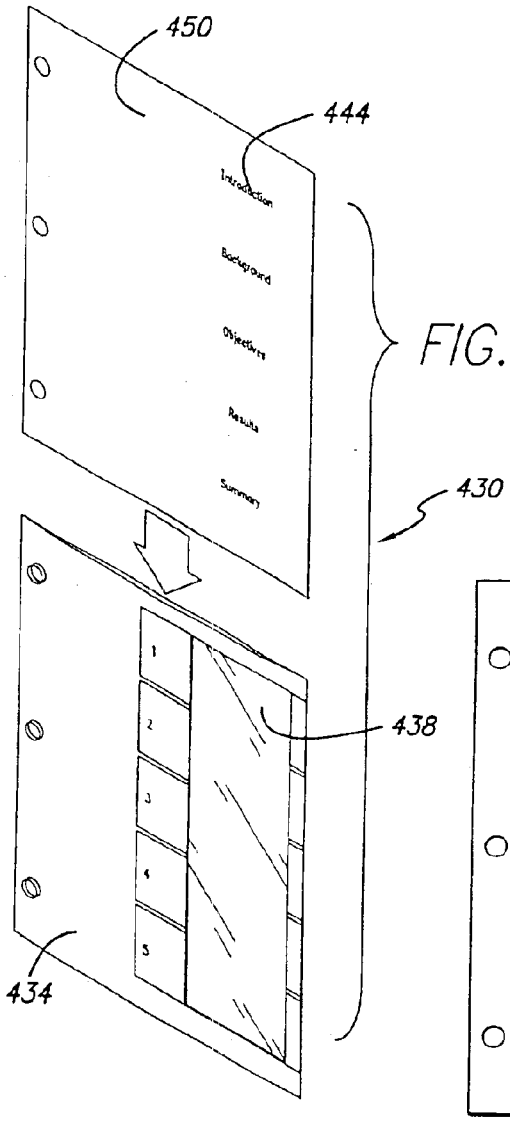
FIG. 12 is a perspective view showing a printed sheet of FIG. 3, for example, being inserted into a pre-printed, windowed sheet protector pocket of the present invention.
Figure 13:
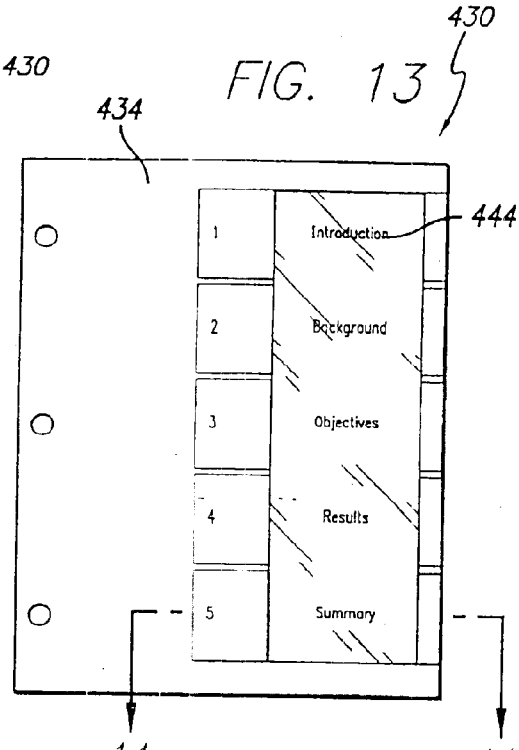
FIG. 13 is a front elevational view of the assembled apparatus of FIG. 12.
Figure 14:
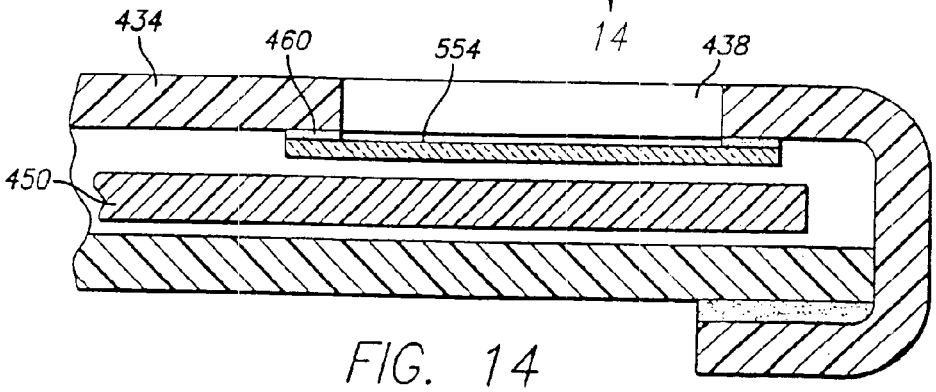
FIG. 14 is an enlarged cross-sectional view taken on line 14—14 of FIG. 13.

The back sheet of the above-discussed pocket apparatuses of the invention can be formed of a transparent plastic. Alternatively, they can be formed with the back sheet being opaque or translucent or some combination thereof. A front sheet of yet another pocket apparatus embodiment 430 does not have a transparent front sheet. Rather, the front sheet 434 is opaque (or translucent) and has a window 438 through which the titles 444 of the title sheet 450, when in the inserted viewing position, can be viewed, as can be understood from FIGS. 12–14. The window 438 can be open (an empty cut-out) or can have a transparent "pane" 454 such as a flexible plastic sheet glued (with glue 460) to an interior surface as best understood from FIG. 14. The embodiment of FIGS. 12 and 13 has the field areas 460 printed (formed or otherwise positioned) on the front sheet adjacent the window 438. Alternatively, the apparatus can be a variation of the apparatuses of FIGS. 7 and 8 or 10 and 11 with the separate field area sheet. And the field area sheet with the title sheet behind it can be positioned in the pocket and viewed through a front sheet window, which would likely be larger than that shown in FIGS. 12 and 13.

There are a number of ways of forming the sheet protectors, as discussed below.

(1) The plastic film is printed in roll form and sent to a machine which produces the sheet protectors. The pre-printing may include an "eye spot" which is detected by the sheet protector manufacturing equipment and results in a feedback system that allows the equipment to register the print so that it is positioned correctly on the sheet protector. The eye spot is cut away as scrap or is printed in a non-visible ink.

(2) The plastic film is printed in roll form and sent to the sheet protector producing machine. The pre-printing does not contain an eyespot, but is toleranced such that the printing is positioned accurately on the sheet protector by virtue of the setup of the sheet protector manufacturing equipment.

(3) The sheet protectors are manufactured using unprinted film. The blank sheet protectors are then sent to another operation where the sheet protectors themselves are printed.

(4) The sheet protectors are manufactured using unprinted film. Print stations are added to the sheet protector manufacturing equipment such that the printing can be performed during the same operation as the sheet protector converting.

(5) Unprinted film is printed in roll form and cut into sheets. These sheets are then folded and/or welded to make the sheet protectors.

Figure 15:
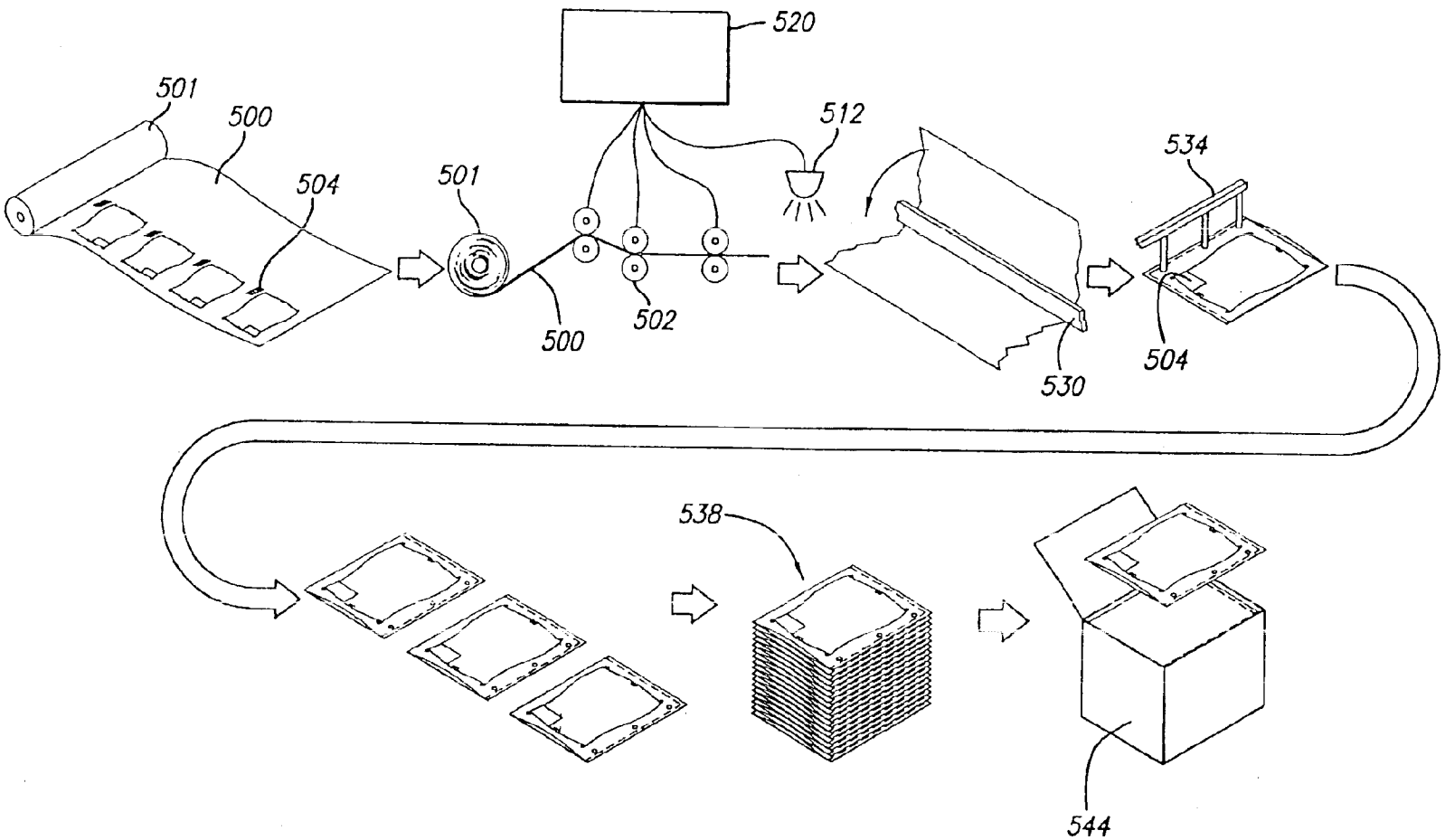
FIG. 15 is a schematic view showing the steps of a manufacturing process of the present invention.

FIG. 15 shows in schematic form the steps of a first manufacturing process of a pocket apparatus of the present invention. A double-wide printed web 500 is provided on a roll 501 and fed through rollers 502, and the eye-marks 504 are sensed at the end of each printed pattern. A sensor 512 senses the eye-marks 504 (e.g., black printed squares) to denote the pattern repeating itself. The sensor feeds back into the roller equipment control 502 to instruct the rollers 502 to go faster or slower so that it gets folded or welded at the correct locations. The sheets are folded 530, welded, hole-punched 534, stacked 538, and boxed or packaged 544.

Figure 16:
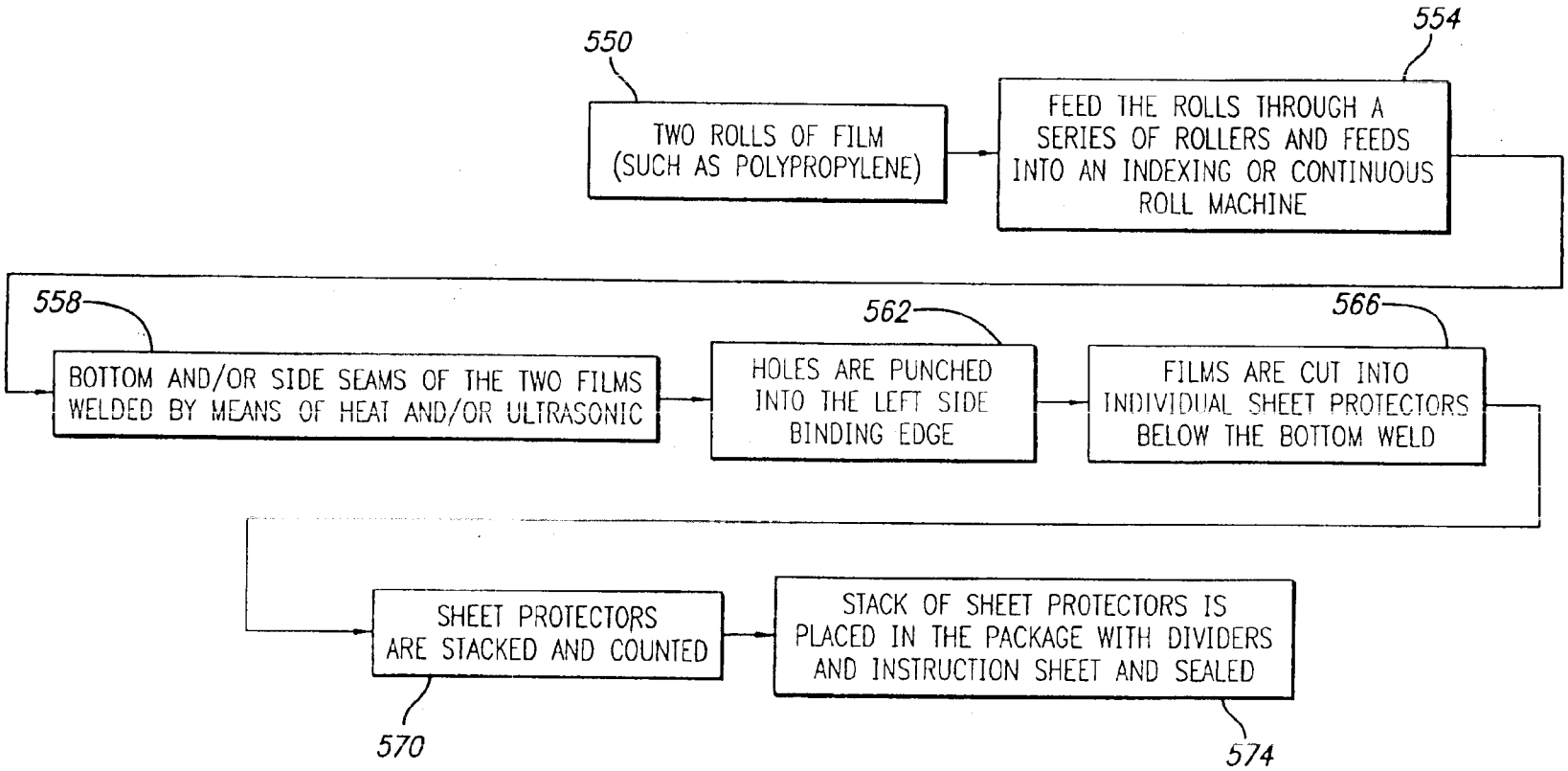
FIG. 16 is a flow chart showing the steps of an alternative manufacturing process of the present invention.

The steps of a second manufacturing process of a pocket apparatus of the present invention are shown in block form in FIG. 16. Referring thereto, briefly, two rolls of film (block 550) are fed into a roll machine (block 554) and the seams are welded together (block 558). Holes are punched in the binding edge as shown by block 562. The films are cut (block 566) below the bottom weld into individual sheet protectors. The sheet protectors are stacked and counted as shown by block 570 and sealed in the package as stated in block 574.

Figure 17:
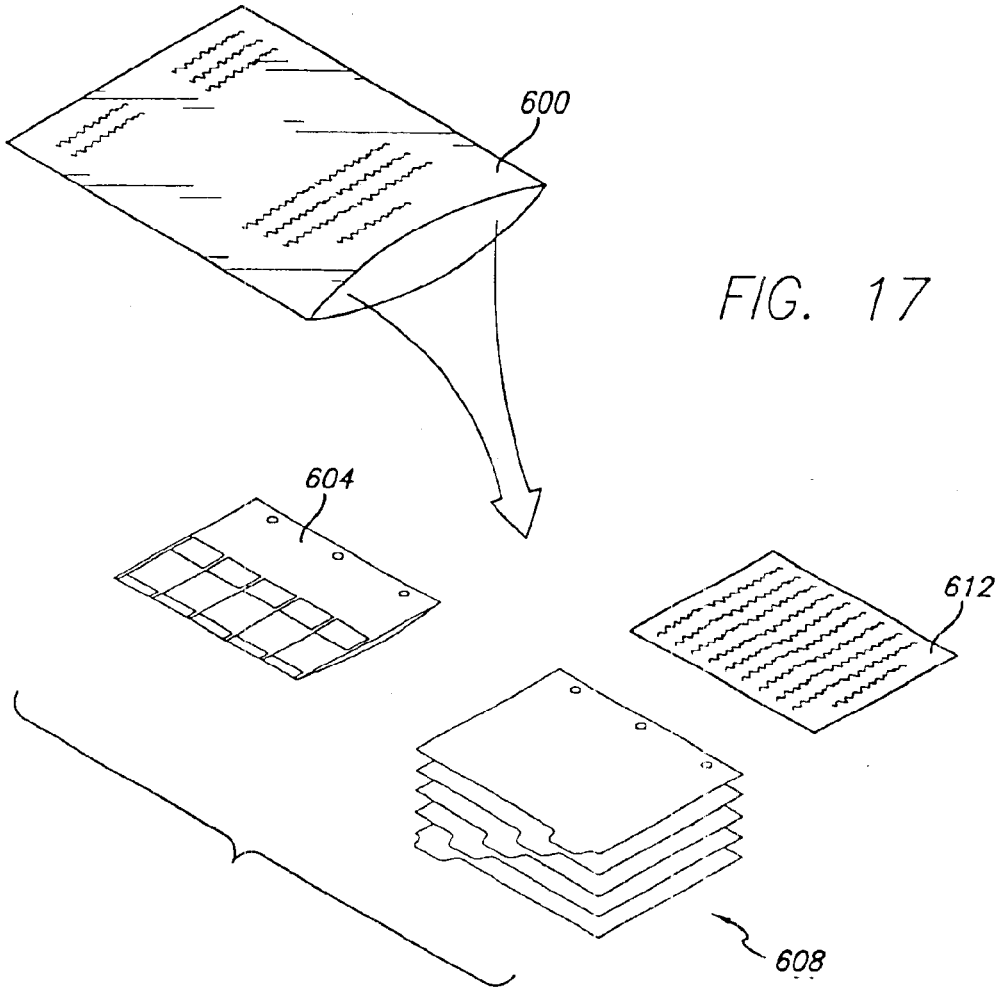
FIG. 17 is an exploded perspective view of a retail packaged divider system of the present invention including the pre-printed sheet protector pocket of FIG. 4, for example.

FIG. 17 shows in perspective how the present invention such as any of the previously-disclosed pocket apparatuses can be supplied to the retail consumer. The product would be sold in a plastic package 600, which contains the pocket apparatus 604, a set of dividers 608, and an instruction sheet 612. The instructions on the instruction sheet alternatively can be printed directly on the plastic package. For the embodiment of FIG. 7, for example, the plastic package (of FIG. 17) can also include the pre-printed transparent sheet.

Figure 18:
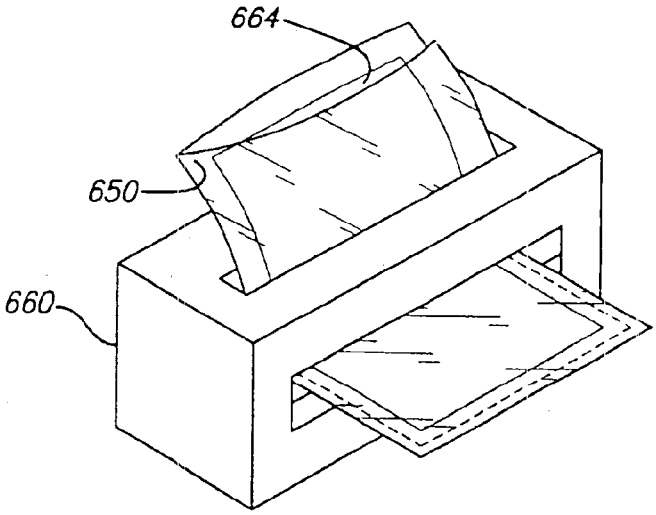
FIG. 18 is a perspective view showing a laminated pocket of the present invention being formed.

The previously-described pocket apparatuses have an open top (or alternatively side) in through which the title sheet is inserted (and out through which it can be removed). The top can remain open, because with the sheet in the pocket apparatus and the pocket apparatus in a ring binder, the rings pass through the binder holes in the pocket apparatus and the aligned binder holes of the contained title sheet, the title sheet is held in the pocket apparatus. Other binding systems will hold the title sheet in the pocket apparatus, too. A flap (see FIG. 25A) can be used to close the open top (or side or bottom), if desired. Alternatively, the pocket apparatus (or folded plastic sheet 650) can be laminated closed with lamination equipment 660, as shown in FIG. 18, about the entire perimeter with the title sheet or other sheet, photograph, newspaper clipping, etc. 664 positioned therein. The pocket apparatus will preferably have some informational and/or decorative pre-printed indicia or designs on the front thereof.

Figure 19:
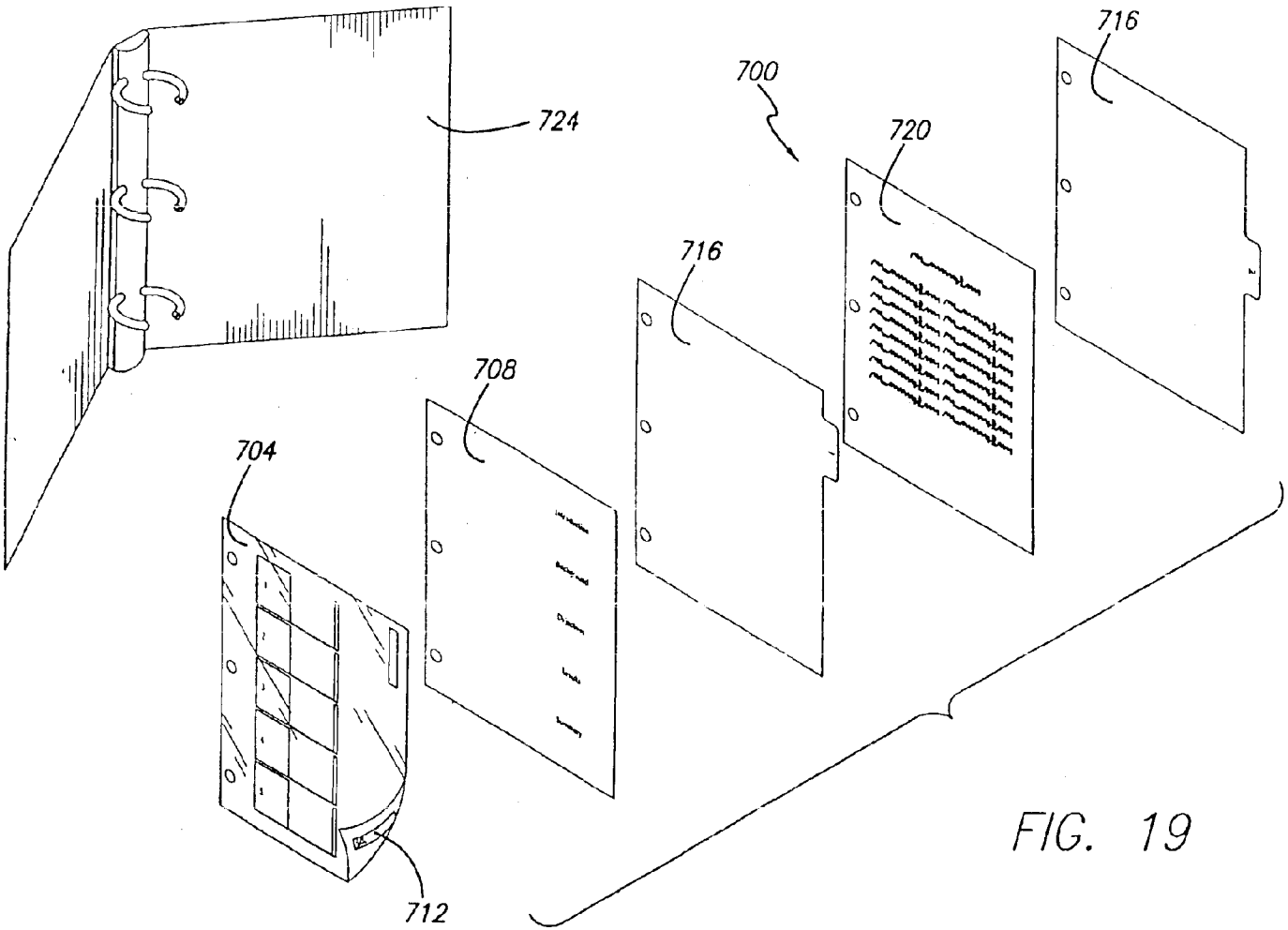
FIG. 19 is a perspective, exploded view of an alternative divider system of the present invention wherein a printed transparency overlay is adhered to a printed sheet to form a two-ply, user-printed table of contents sheet, which is assembled with tabbed dividers and sheet inserts into a ringed binder (or other binding system)

In lieu of a pocket apparatus, an alternative system 700 of the present invention is illustrated in FIG. 19. Referring thereto, a transparent, single layer pre-printed table of contents sheet 704 is provided and the custom formatted and printed title sheet 708 is adhered to the back of the table of contents sheet with adhesive strips 712 or the like. The two-ply sheet can then be assembled with tabbed dividers 716 and document sheets 720 into a ringed binder 724, or into another binder system. Instead of being pre-printed the table of contents sheet can be custom formatted and printed by the user.

Figure 20:
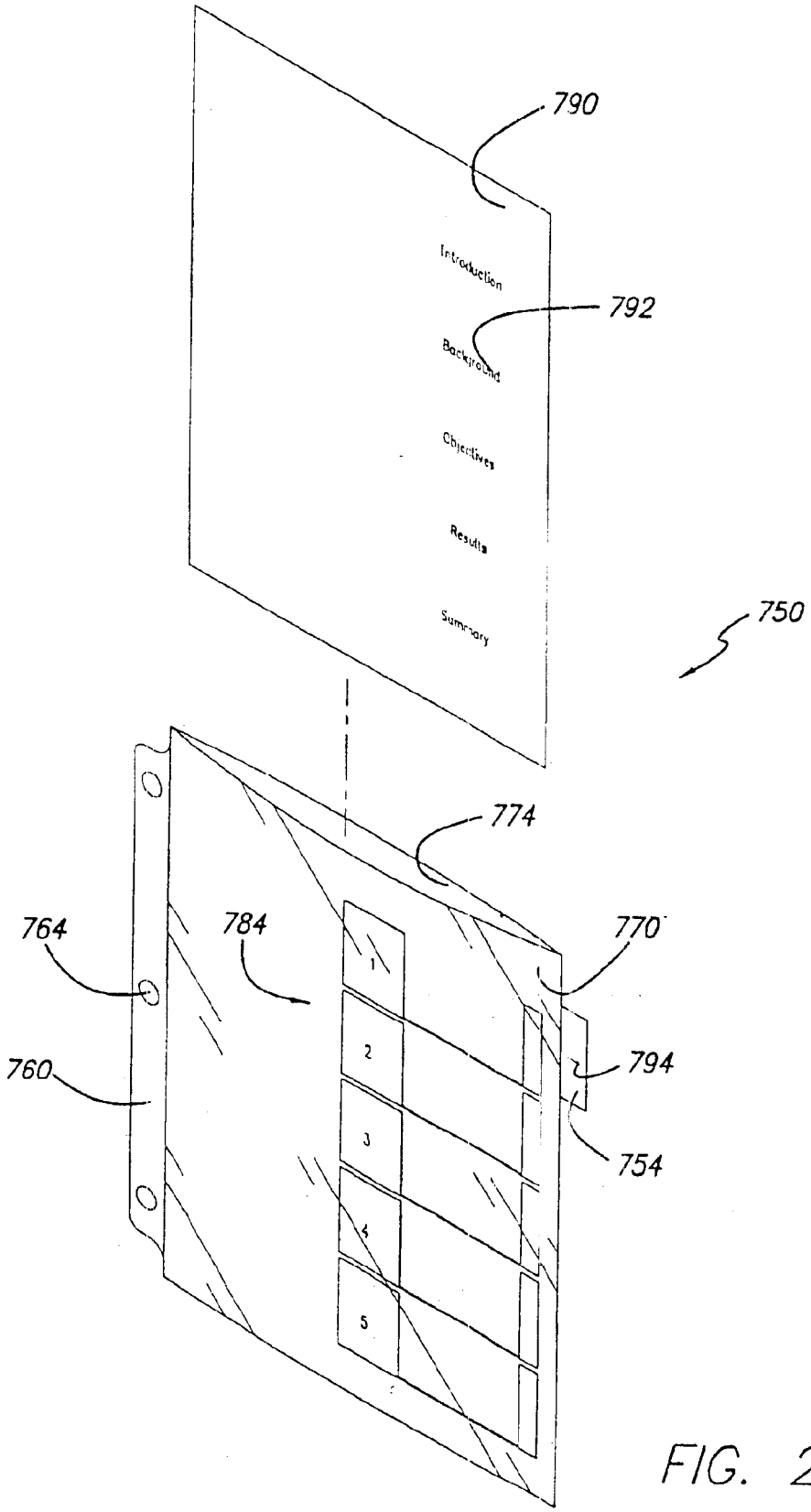
FIG. 20 is a perspective view illustrating a printed sheet, such as that of FIG. 3, being inserted into a pre-printed tabbed transparent sheet protector pocket to form an assembly of the present invention.

A further alternative pocket embodiment is shown in FIG. 20 at 750. One difference between it and the embodiment of FIG. 4 is that a divider tab 754 extends out from an edge of the pocket apparatus and is preferably integrally formed therewith. Although it is depicted as having a binder strip 760 (with binder holes 764) extending out from an opposite edge of the pocket apparatus, the binder holes can be formed to pass through the front and back sheets 770, 774 of the pocket apparatus, similar to embodiments illustrated in earlier drawing figures. Alternatively, those embodiments can be provided with the binder strip.

Figure 2:
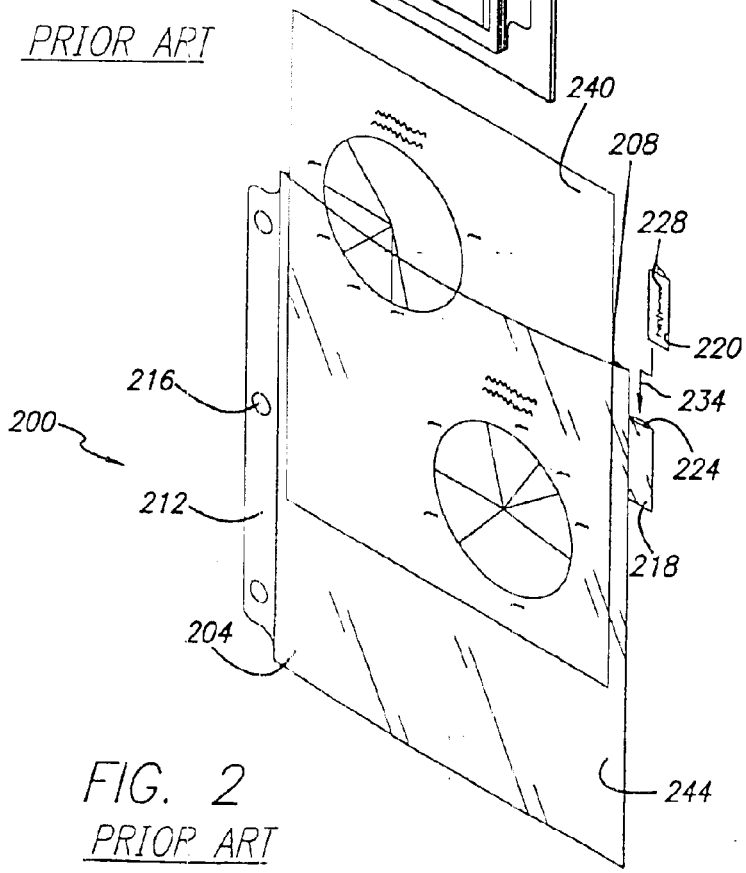
FIG. 2 PRIOR ART
FIG. 2 is a perspective view of a partially-exploded tabbed sheet protector assembly of the prior art.

By having the tab 754 attached to the pocket apparatus 750, the pocket apparatus is not only a table of contents but also serves as a tabbed divider and can have a number of other identifying indicia pre-printed thereon. Unlike the prior art tabbed pocket apparatus of FIG. 2, the tabbed pocket apparatus of FIG. 20 has the descriptive fields 784 pre-printed thereon and has a custom formatted title sheet 790 with printed titles 792 inserted thereon. Also, it preferably has the tab indicia pre-printed 794 thereon.

Figure 21:
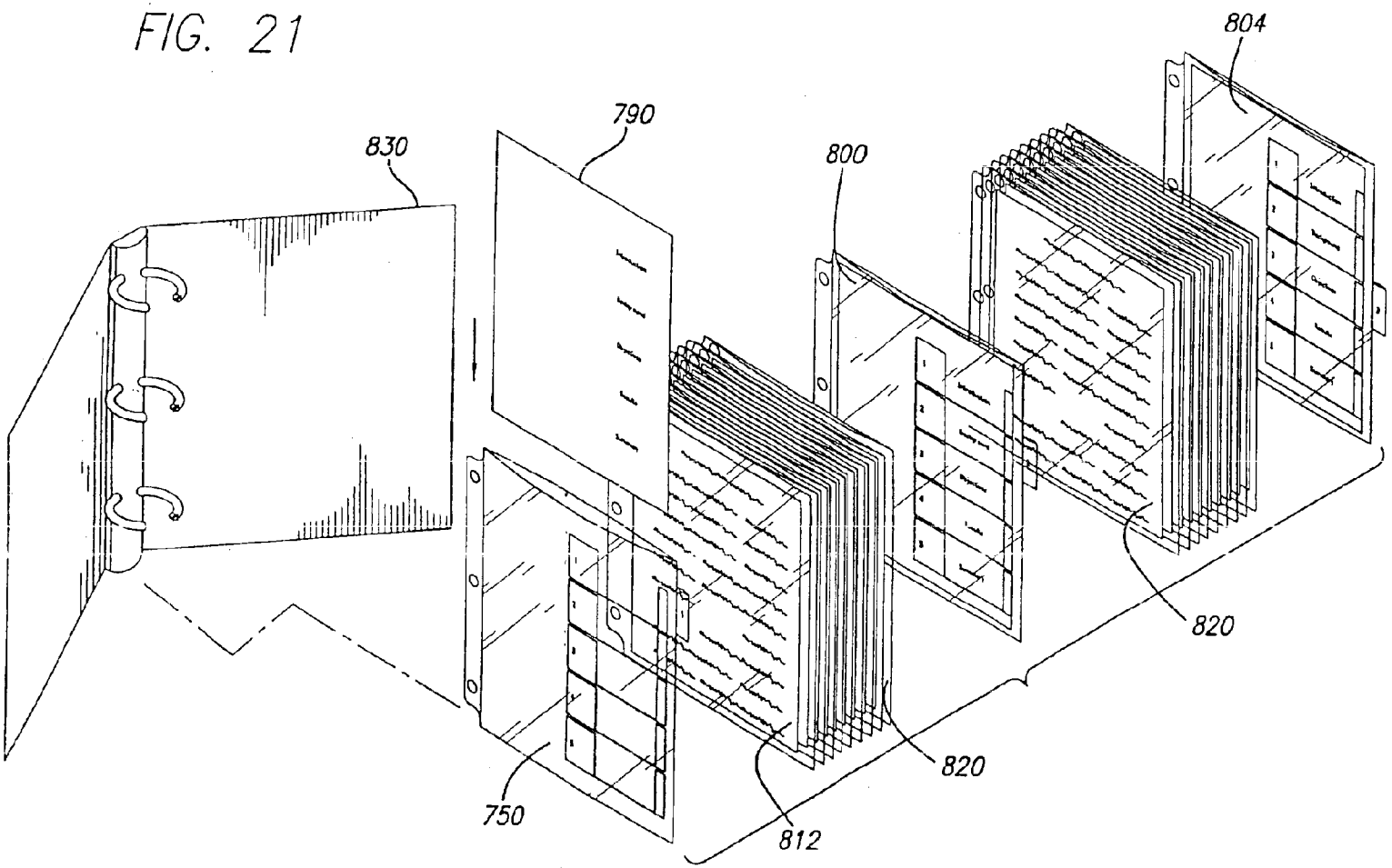
FIG. 21 is a perspective exploded view of an alternative tabbed divider system of the present invention wherein the assembly of FIG. 20 is assembled with similar assemblies having differently placed tabs and with non-tabbed sheet protectors into a ringed binder (or other binding system)

Referring to the system shown generally at in FIG. 21, the tabbed pocket apparatus 750 is assembled with similar tabbed pocket apparatus 800, 804 having different indicia and positioned tabs, and with document sheets 812 positioned between the tabbed pocket apparatuses. The title sheets 790 for each of the tabbed pocket apparatuses can be identical. The document sheets 812 can also be positioned in (untabbed) transparent pocket dividers 820, as illustrated. A single sheet or multiple sheets can be positioned in each transparent pocket divider 820. And the tabbed pocket apparatuses (with title sheets) and the transparent pocket dividers (with inserted sheets) can be assembled in a ring binder 830 or other binding system.

Figure 22:
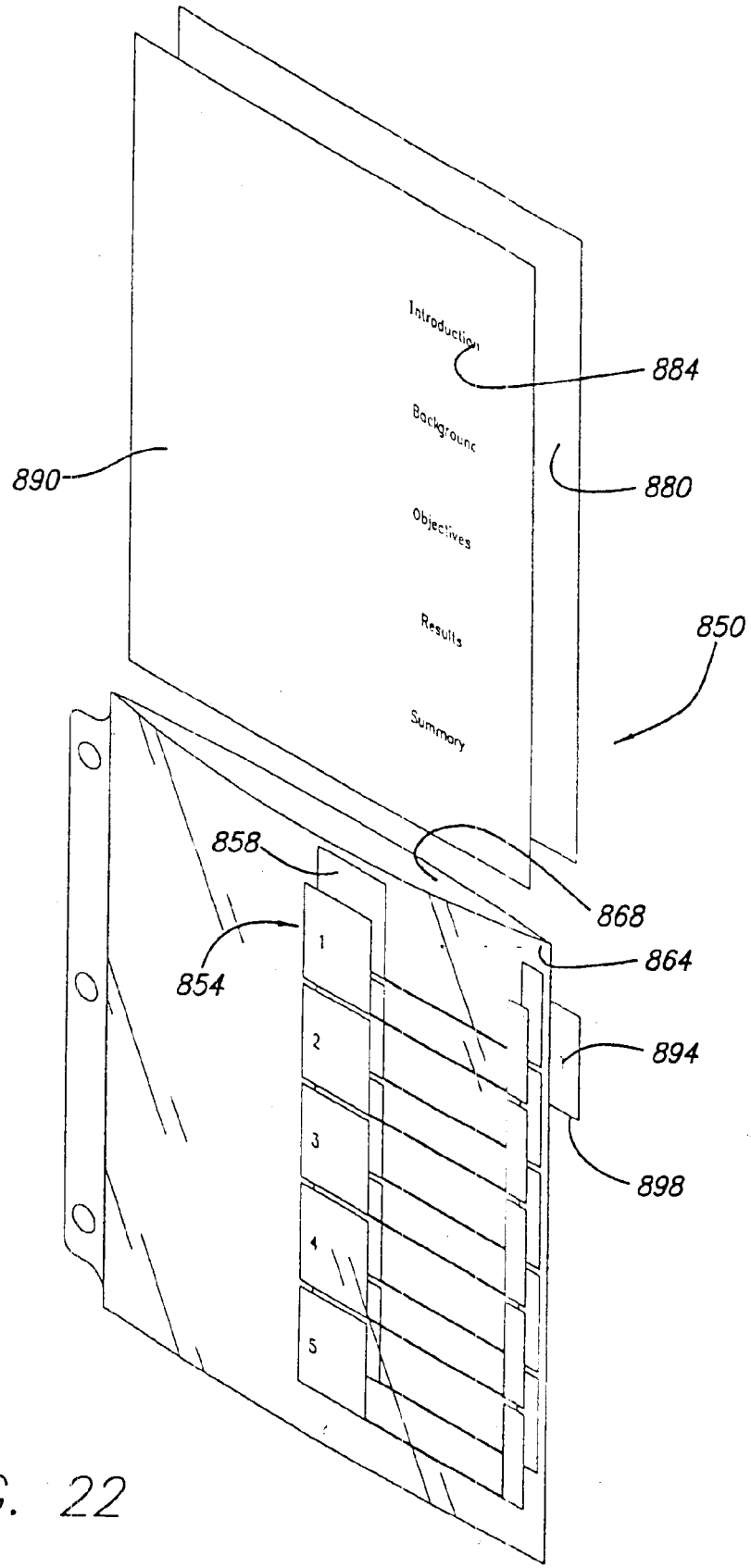
FIG. 22 is a perspective view illustrating similar front and back printed sheets (such as those of FIG. 3) being inserted (back-to-back) into a tabbed transparent sheet protector pocket having pre-printed front and back sides and with indicia (numbers) pre-printed on front and back sides of the integral tabs of the pocket.

Another tabbed pocket apparatus is illustrated in FIG. 22 at 850. It is similar to that of FIG. 20, except that descriptive fields 854, 858 are printed on the transparent front and back sheets 864, 868, and a rear title sheet 880 preferably having the same title 884 printed thereon is inserted rearwardly facing into the pocket behind the front title sheet 890. Indicia 894 is preferably printed on the back side of the tab 898 as well as the front. Thereby, with the binding system open and the back of the tabbed pocket apparatus being exposed the user can identify the number and title of the tabbed section on the left side of the notebook (or other binding system). Instead of having two back-to-back title sheets, a single title sheet printed on both sides can be used. This tabbed pocket apparatus can be used in a system similar to that of FIG. 21.

Figure 23:
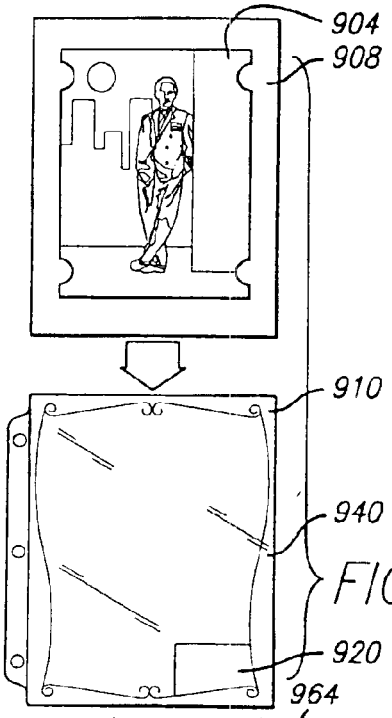
FIG. 23 is a front elevational view showing a photograph (tab-mounted to a backing sheet) being inserted into an alternative pre-printed transparent sheet protector pocket of the present invention.

Most of the previously-described pocket apparatuses are primarily designed to hold a title sheet. However, other documents, pages, papers, clippings or flat articles 904 can be stored and displayed therein. One example is to use them to store and display photographs (or other flat images), such as in the embodiments of FIGS. 23–26. Where the photographs are smaller than the pocket, the photographs can be held on a tabbed sheet 908, such as is illustrated at the top of FIG. 23. The tabbed sheet 908 holds the photograph 904 in place in the pocket apparatus 910 so it does not slide around from side to side or become crooked. It also provides an attractive border for the photograph and protects the edges of the photograph from damage. The tabbed sheet 908 can be similar to that provided in the prior art FRAMED VIEW BINDER available from Avery Dennison Corporation.

In other words, the present inventions improve upon the prior art sheet protector photopages which have welded sections to hold photos of popular sizes. The utility of the prior art product is increased by providing a writeable section 920 on the protector 910 on which the user can date or journal 934 (FIG. 24) adjacent the photograph 904. The attractiveness and utility is increased by providing decorative borders or accent designs 940 to the photographs. The consumer's ability to collage the photopage is increased according to one aspect of the invention by providing several sections for photographs and attractive themed designs to enhance the contents of the photographs.

The pocket assemblies of FIGS. 23–26 each have pre-printed design, indicia or image 940 on their front (and/or back) sheet. This preferably takes the form of a decorative border. And the border can be configured with a theme which corresponds to or compliments the material to be placed in the pocket. A good example of this is the embodiment depicted in FIG. 26 which has a wedding theme wherein the inserted photograph is a wedding photograph and the pre-printed frame has a wedding theme with bells, a bible and flowers. The pre-printed matter instead of a frame can be decorative elements or trademarked designs or images or generally anything. However, it should preferably not completely obscure the underlying stored sheet and in fact should complement it.

Figure 24:
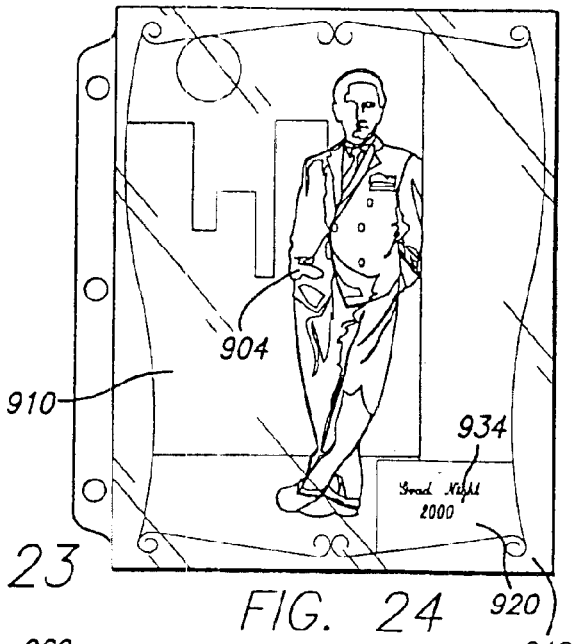
FIG. 24 is an enlarged front elevational view of the assembled apparatus of FIG. 23 with user-custom writing on a lower right writing panel thereof.
Figure 25:
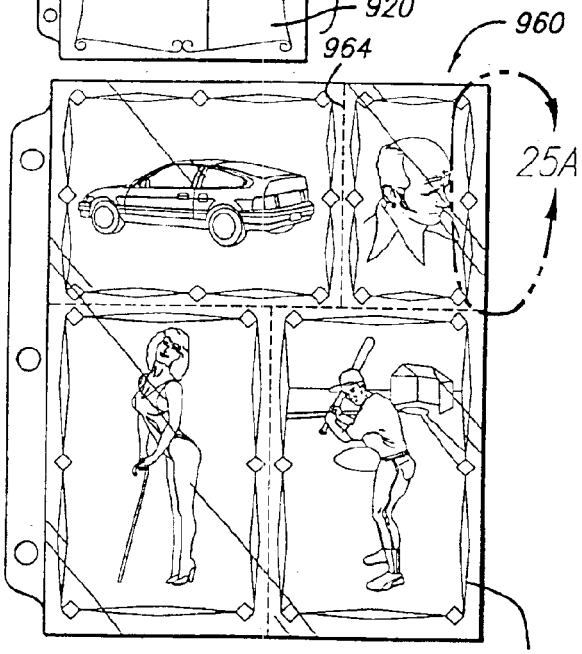
FIG. 25 is a front elevational view showing four photographs inserted in another alternative pre-printed transparent sheet protector pocket of the present invention.
Figure 26:
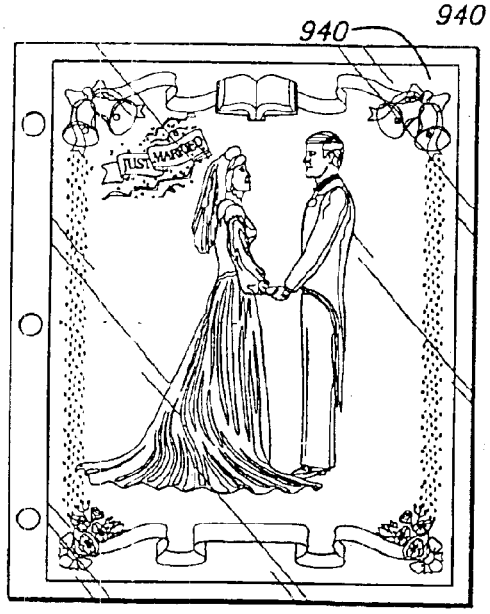
FIG. 26 is a front elevational view illustrating a photograph inserted in yet another alternative pre-printed transparent sheet protector pocket of the present invention.
Figure 25A:
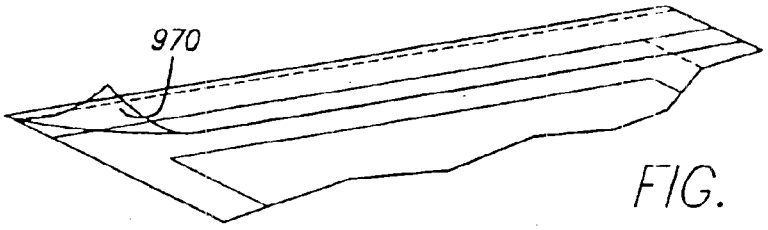
FIG. 25A is an enlarged perspective view taken on circle 25A of FIG. 25 showing a pocket flap.
Figure 27C:
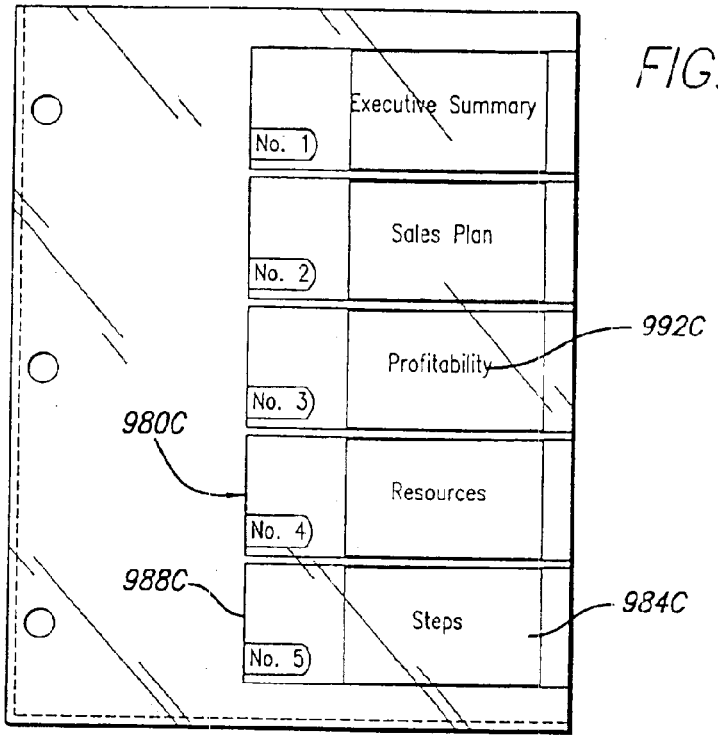
Figure 27D:
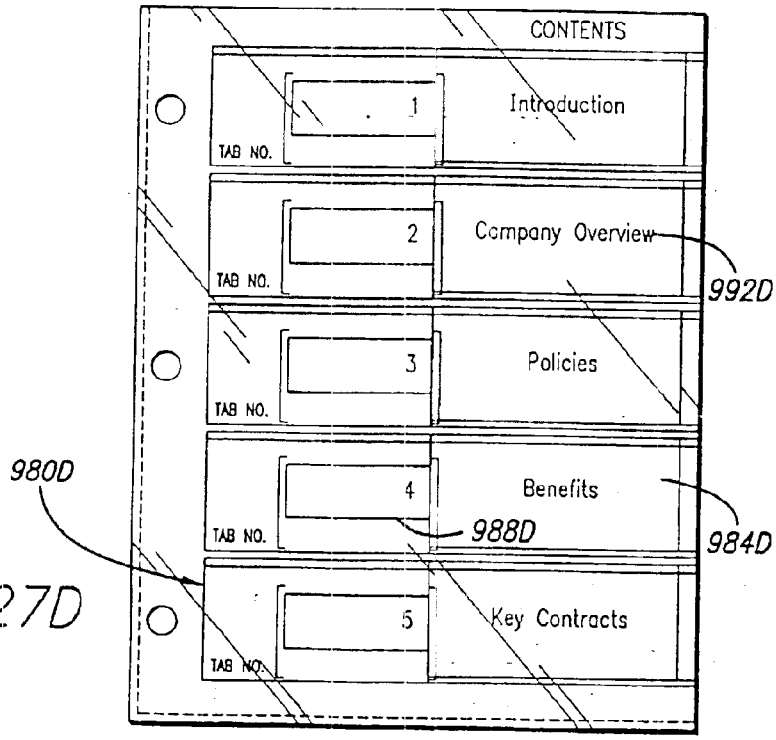

The pocket apparatus can include a surface adapted to be handwritten on by a user with a pen or pencil; such surface is shown in the bottom right corner of FIG. 24 at 920. A further variation of the present invention is to provide a number of pockets each to hold a separate photograph (or other flat object), such as depicted in FIG. 25 by apparatus 960. Each pocket can be separated from the others by welded seams 964. And each pocket will have an opening for inserting the photograph. The opening can be closed with a flap 970, such as shown in FIG. 25A, and having a configuration known in the prior art. Each of the pockets can have its own pre-printing on the front sheet; and the pre-printing can be frame designs 972 as depicted in FIG. 25.

FIGS. 27A–D show alternative designs of the (e.g., rectangular) pocket apparatus, as compared with those of FIGS. 5, 8, 13, 20 and 22. They can have binder holes (as shown) and/or index tabs and/or windows and/or front and back designs as discussed above. Referring to FIGS. 27A–D, the designs include a series of pre-printed fields, each preferably abutting the right edge and preferably aligned with a separate tab when in a binding system with tabbed dividers, and preferably having different colors or shading as described previously. Five fields 980A, 980B, 980C, 980D are shown but different numbers of fields can be provided as desired. Each of the fields has an unprinted area 984A, 984B, 984C, 984D surrounded by a printed area 988A, 988B, 988C, 988D. The titles 992A, 992B, 992C, 992D (or other indicia) on the inserted sheet are clearly visible through the respective unprinted areas.

A usable polypropylene for the pocket apparatuses disclosed herein is a cast polypropylene having a COF of 0.25–0.29. The low COF can be accomplished by adding a slip agent to the formulation of the film, in a known manner. The polypropylene is corona treated to forty to forty-four dyne level; this is a customary step for printing film, the corona treatment charges the film to change the electrostatic properties of the film and makes it more ink receptive. The film is then passed through the print stations and is printed flexographically using UV inks applied with a photopolymer plate. Most narrow web printing operations use several (four to eight) print stations. The print stations can be used to print PMS colors; in other words, the exact color of ink that is desired is loaded into the station and printed. Another option for printing is Process printing—to load four or more colors of ink—black, cyan, magenta and yellow into the print stations to create any color that is desired by laying down layers of these four colors. Process printing is done for products that require more colors than there are stations on the printing press. For a preferred product, up to sixteen colors are printed on the sheet protector. The process is a process printing using six base colors of ink—black, orange, green, cyan, yellow and magenta. This is called hexachrome printing, and it is normally done on offset printing presses, not on flexographic printers. An example of a printer of the invention uses UV hexachrome inks on the flexographic press.

The first print station prints the eye-marks. There is a photo-eye at each following station which registers the eye-mark and prints the next color with reference to the position of the eye-mark. The tolerance is normally held±0.005". The last print station applies a clear varnish to the entire surface of the film. It is an antistatic, slip varnish, which is also UV cured. It is applied in thickness from one mil to twenty mils. There are different varnishes available depending on the desired level of COF for the final product. Slip varnish is normally used for printing clear labels for in-mold labels, used on shampoo bottles and other such products. The reason the slip is used is because the labels are stacked in stacks of fifty, and a star wheel pulls off one label at a time for use in putting on the bottle. If there is no slip agent or antistatic varnish, the labels will generate static from the friction of the star wheel and stick to each other. The printed film is wound on a roll and shipped.

The writable coating 920 can be UV ink-white opaque ink printed in the same manner, with two layers used for higher levels of opacity. This coating is similar to that currently used for oil changing "reminder" stickers.

An alternative to the above-described process for printing the decorative and informational indicia, designs or images on the (polypropylene) pockets and sheets is an ink jet printing technique. Pursuant to this technique, the polypropylene is coated with an ink jet receptive coating after extrusion or it is surface treated (embossed) during the extrusion process to accept ink. The web or large sheet of polypropylene is run through a large format ink jet printer. The ink jet printer creates the image by dripping very small droplets of ink such that a the desired image pattern is thereby created. An example of an inherently inkjet printable coextrudable film embodiment and various office product applications of the film are disclosed in copending application entitled "Inherently Ink Receptive Film Substrates," Ser. No. 09/547,942, filed Apr. 11, 2000.

Screen printing is another method which can be used. Pursuant to this method, the desired image is separated into base colors (i.e., black, magenta, yellow, cyan). Each of the color separations is separately printed. The image of each color is burned into a screen by placing the negative of the color image over a light sensitive screen and exposing it to light, whereby the light expands through pores in the screen. This process can also be done using chemicals instead of light. The screen is then placed on top of the polypropylene or other media that is to be imaged, and ink is spread evenly over the top of the screen. The ink flows through the pores and adheres to the surface of the polypropylene in the desired locations. The process is repeated for each of the base colors until the desired image is achieved. The (polypropylene) media will likely need to be first treated to better accept the ink. This treatment can be done by corona treating it or by coating it with a varnish that acts as a "primer."

Generally, any of the assemblies described herein can be manufactured from polypropylene, vinyl, polyester, polystyrene or any other clear or translucent film that can be formed into a sheet protector. The welding and/or folding of the films can be accomplished by means of heat, ultrasonic, pressure or deformation. Further to the disclosures provided above, examples of possible geometries of the sheet protector are:

(1) A pre-printed 8½ by eleven inch sheet protector, welded at the binding edge and bottom, folded on the right edge and open at the top. The consumer desktop prints his tab titles on a plain sheet of paper, and may or may not hole punch the sheet to line up with the holes in the sheet protector. When the sheet is inserted into the sheet protector, the titles line up with the colored areas of the sheet protector.

(2) A pre-printed 8½ by eleven inch sheet protector, welded at the bottom only, folded along the right edge and open at the binding edge with a three hold punch, in a "quick-load" configuration. The page to be inserted is three hole punched and inserted by peeling back the flap and sliding in the sheet. Once the page is inserted, the assembly can be assembled in a three ring binder or report cover.

(3) A pre-printed 8½ by eleven inch sheet protector that is not welded, but is a folded piece of pre-printed clear film. The fold is along the right side, and the two loose ends are three hole punched. The inserted page is three hole punched and slid between the layers of film, then inserted into a binder or report cover.

(4) A pre-printed paper sleeve with a window, which may or may not have a clear plastic covering. The consumer desktop prints his tab titles on a plain sheet of paper, hole punches the sheets and inserts the printed sheet into the sleeve. The desktop printed tab titles are visible through the window.

(5) A pre-printed 8½ by eleven inch sheet protector (or paper sleeve) with one-half inch sealed binding edge, so that the sleeve is eight inches wide. The software template is changed slightly so that a dashed line is printed out with the tab titles one-half inch from the left edge of the sheet. The consumer can cut along the line or fold the sheet along the line so that the resulting sheet is eight inches wide and can be inserted into the eight inch wide sleeve of the sheet protector. Once inserted, the tab titles line up with the colored areas of the sleeve.

(6) Pre-printed 8½ by eleven inch sheet protector (or paper sleeve) with ½ inch sealed binding edge, so that the sleeve is eight inches wide. A sheet of paper is provided that is perforated ½ inch from the edge along the eleven inch edge of the sheet. After the consumer has printed the perforated sheet, he can removed the perforated edge so that the resulting sheet is eight inches wide and can be inserted into the eight inch wide sleeve of the sheet protector. Once inserted, the tab titles line up with the colored areas of the sleeve.

(7) Pre-printed nine by eleven inch sheet protection, with ½ inch welded binding edge. The consumer desktop prints his tab titles on a plain sheet of paper, then inserts the sheet into the sheet protector. Once inserted, the tab titles line up with the colored areas of the sleeve. Since the clear view table of contents is now nine by eleven inches, the dividers should be extra wide, 9½ by eleven inches.

(8) The invention is a single layer of film or thicker plastic.

From the foregoing detailed description, it will be evident that there are a number of changes, adaptations and modifications of the present invention which come within the province of those skilled in the art. However, it is intended that all such variations not departing from the spirit of the invention be considered as within the scope thereof. A Table showing various alternative constructions of the present inventions follows.

TABLE

| | decorative sheet protector | Clear View TOC | Paper view TOC | photoframe sheet protector | Ink Jet printable sheet protector | Ink Jet printable insert sheet protector | printed insert sheet protector | clear poly dividers | Printed Lamination Pouch | Printed lamination overlay |
|---|---|---|---|---|---|---|---|---|---|---|
| Materials | | | | | | | | | | |
| polypropylene | x | x | | x | x | x | x | | x | x |
| vinyl | x | x | | x | x | x | x | | x | x |
| polyester | x | x | | x | x | x | x | | x | x |
| polystyrene | x | x | | x | x | x | x | | x | x |
| clear or translucent film | x | x | | x | x | x | x | x | x | x |
| rigid clear or translucent plastic | | | | | | | | x | | |
| paper and film combination | x | | x | x | x | | | | | |
| Paper only | | | x | | | | | | | |
| Method of printing | | | | | | | | | | |
| Preprinted rolls | x | x | | x | | | x | | x | x |
| UV | x | x | x | x | | | x | x | x | x |
| Flexographic | x | x | x | x | | | x | x | x | x |
| Offset | x | x | x | x | | | x | | x | x |
| Process | x | x | x | x | | | x | x | x | x |
| Ink Jet | x | x | x | x | | | x | x | x | x |
| Preprinted Sheets of Poly Film | x | x | x | x | | | x | x | x | x |
| UV | x | x | x | x | | | x | x | x | x |
| Flexographic | x | x | x | x | | | x | x | x | x |
| Offset | x | x | x | x | | | x | x | x | x |
| Process | x | x | x | x | | | x | x | x | x |
| Screen Printing | x | x | x | x | | | x | x | x | x |
| Ink Jet | x | x | x | x | | | x | x | x | x |
| Ink Jet coated film | | | | | x | x | x | x | x | x |
| Print on line | x | x | | x | | | x | x | x | x |
| foil stamp | x | x | x | x | | | | x | x | x |
| UV | x | x | x | x | | | | x | x | x |
| Flexographic | x | x | x | x | | | | x | x | x |
| Offset | x | x | x | x | | | | x | x | x |
| Process | x | x | x | x | | | | x | x | x |
| Ink Jet | x | x | x | x | | | x | x | x | x |
| Print finished sheet protectors | x | x | x | x | | | x | x | x | x |
| foil stamp | x | x | x | x | | | x | x | x | x |
| UV | x | x | x | x | | | x | x | x | x |
| Flexographic | x | x | x | x | | | x | x | x | x |
| Offset | x | x | x | x | | | x | x | x | x |
| Ink Jet | x | x | x | x | | | x | x | x | x |
| Screen Print | x | x | x | x | | | x | x | x | x |
| Process | x | x | x | x | | | x | x | x | x |
| Geometries of sheet protectors | x | x | x | x | x | x | x | | x | |
| 7 ½ × 11 pocket, no binding edge | x | x | x | x | x | x | x | | x | |
| 8 × 11 overall, 8 ½ × 11 pocket, with binding edge | x | x | x | x | x | x | x | | x | |
| 7 ½ × 11 overall, 8" pocket with binding edge | x | x | x | x | x | x | x | | x | |
| Welded on bottom and left side, open on top | x | x | x | x | x | x | x | | x | |
| Welded on bottom only, folded on right, open on left and top | x | x | x | x | x | x | x | | x | |
| no welds, folded on right side only | x | x | x | x | x | x | x | | x | |
| welded on left, right and bottom, open on top | x | x | x | x | x | x | x | | x | |
| Welded on top & bottom, folded on right, open on left side | x | x | x | x | x | x | x | | x | |
| Welded on top & bottom, folded on left, open on right | x | x | x | x | x | x | x | | x | |
| Welded on top, bottom, right, open on left | x | x | x | x | x | x | x | | x | |

TABLE-continued

| | decorative sheet protector | Clear View TOC | Paper view TOC | photoframe sheet protector | Ink Jet printable sheet protector | Ink Jet printable insert sheet protector | printed insert sheet protector | clear poly dividers | Printed Lamination Pouch | Printed lamination overlay |
|---|---|---|---|---|---|---|---|---|---|---|
| Welded on top, bottom, left, open on right | x | x | x | x | x | x | x | | x | |
| single sheet of film | x | x | | x | x | x | x | x | x | x |
| single sheet of film with PSA on back side | x | x | | x | x | x | x | x | x | x |
| folded paper with cut out window | | | x | x | x | x | | | | |
| Folded paper with cut out window, window is covered by a layer of clear film | | | x | x | x | x | | | | |

What is claimed is:

1. An index divider system, comprising:

a set of dividers having staggered tabs;

a sheet having a plurality of sheet indicia printed thereon, each aligned with a respective one of the tabs when the sheet is assembled with the set of dividers; and a sheet protector pocket having a front sheet and a back sheet, the front sheet allowing the sheet indicia to be viewed therethrough with the sheet disposed in the pocket in a viewing position, and the front sheet having printed indicia thereon associated with and generally in alignment with the sheet indicia with the sheet in the viewing position.

2. The system of claim 1 wherein the front sheet is transparent.

3. The system of claim 1 wherein the dividers and the pocket have binder holes which are aligned with one another when the dividers and the pocket are in a binding system.

4. The system of claim 1 wherein the binding system is a three-ring binder notebook.

5. The system of claim 1 wherein the sheet indicia is user-designed and printed.

6. The system of claim 1 wherein the pocket has an open top in through which the sheet is inserted into the viewing position, and closed side and bottom edges.

7. The system of claim 1 wherein the pocket has an open top and at least one open side.

8. The system of claim 1 wherein the front and back sheets are formed from two separate webs that are welded together.

9. The system of claim 1 wherein the front and back sheets are formed from a single web that is folded onto itself.

10. The system of claim 1 wherein the front and back sheets comprise plastic film.

11. The system of claim 1 wherein the sheet indicia comprise alpha descriptors and the printed indicia comprise numerical descriptors.

12. The system of claim 1 wherein the sheet indicia and the printed indicia both comprise alpha descriptors.

13. The system of claim 1 wherein the sheet indicia comprise user printed indicia.

14. The system of claim 1 wherein the sheet indicia are applied using a printer, a copier, a typewriter or by hand.

15. The system of claim 1 wherein the sheet indicia comprise manufacturer preprinted indicia.

16. The system of claim 1 wherein the dividers, the sheet and the pocket each have binder holes.

17. The system of claim 16 wherein a storage area defined by the pocket has slightly larger width and length dimensions than those of the sheet to maintain the sheet therein and the holes of the sheet and the pocket aligned.

18. The system of claim 16 wherein the pocket includes a binder strip sealed to the front and back sheets and through which the binder holes pass.

19. The system of claim 1 wherein the sheet comprises a paper sheet.

20. The system of claim 1 wherein the dividers comprise opaque paper dividers.

21. The system of claim 1 further comprising sheet inserts between the dividers of the set.

22. The system of claim 1 wherein the pocket includes a binder strip having binder holes and extending out from the front and back sheets.

23. An index divider system, comprising:

a package;

a set of dividers having staggered tabs, the dividers being disposed in the package and removable therefrom;

a sheet protector pocket disposed in the package and removable therefrom;

the pocket having a front sheet and a back sheet;

the pocket having an opening adapted to receive therein between the front and back sheets, with the pocket removed from the package, and into a viewing position a sheet having a plurality of sheet indicia printed thereon, each indicia aligned with a respective one of the tabs when the sheet is assembled with the set of index dividers, with the dividers removed from the package;

the front sheet allowing the sheet indicia to be viewed therethrough with the sheet in the viewing position; and the front sheet having printed indicia thereon associated with and generally in alignment with the sheet indicia with the sheet in the viewing position.

24. The system of claim 23 wherein the pocket and the dividers have binder holes.

25. The system of claim 23 wherein the package comprises a plastic package.

26. The system of claim 23 further comprising an instruction sheet disposed in the package and removable therefrom by a user.

27. The system of claim 23 wherein the sheet is disposed in the package and removable therefrom for application of the sheet indicia thereon and insertion in the pocket.

28. An index divider system, comprising:

a set of dividers having staggered tabs;

a sheet protector pocket having a front sheet and a back sheet;

the pocket having an opening adapted to receive therein between the front and back sheets, and into a viewing position, a sheet having a plurality of sheet indicia printed thereon, each indicia aligned with a respective one of the tabs when the sheet is assembled with the set of index dividers;

an at least partially transparent sheet positionable in the pocket so as to be in front of the sheet and in a viewing position;

the front sheet allowing the sheet indicia to be viewed therethrough with the sheet in the viewing position and through the transparent sheet disposed in front of the front sheet in the pocket; and with the transparent sheet in the viewing position, the front sheet allowing indicia on the transparent sheet to be viewed therethrough.

29. An index divider system, comprising:

a set of dividers having staggered tabs;

a first sheet having a plurality of first sheet indicia thereon;

a second sheet having a plurality of second sheet indicia thereon;

the first sheet being adhered to a back of the second sheet to form a sheet assembly with the first sheet indicia being visible through the second sheet; and with the sheet assembly assembled, the first and second sheet indicia are aligned with respective ones of the tabs.

30. The system of claim 29 wherein the sheet assembly includes binder holes and the dividers include binder holes.

31. An index divider system, comprising:

a set of dividers having staggered tabs;

a first sheet having a plurality of first sheet indicia thereon;

a second sheet having a plurality of second sheet indicia thereon;

the first sheet being bound with the second sheet to form a sheet assembly with the first sheet indicia being visible through the second sheet; and with the sheet assembly stacked on and bound with the dividers the first and second sheet indicia being aligned with respective ones of the tabs.

32. The system of claim 31 wherein the first sheet is bound with the second sheet using a binding system selected from the group of tape binding, thermal binding, comb binding, velo binding and staple binding.

33. A sheet holding and viewing apparatus, comprising:

a sheet protector pocket having a front sheet, a back sheet, an opening and a plurality of binder holes;

the pocket being adapted to receive therein and into a viewing position through the opening a sheet having a plurality of sheet indicia thereon;

the front sheet allowing the sheet indicia to be viewed therethrough with the sheet disposed in the pocket; and the front sheet having indicia thereon associated with and generally in alignment with the sheet indicia with the sheet in the viewing position.

34. The apparatus of claim 33 wherein the front sheet indicia are printed thereon.

35. The apparatus of claim 33 wherein the sheet defines a front sheet, wherein the pocket is adapted to receive therein and into a viewing position through the opening a second sheet having a plurality of sheet indicia thereon, and wherein the back sheet allows the sheet indicia of the second sheet to be viewed therethrough with the second sheet in the viewing position, and the back sheet has printed indicia thereon associated with and generally in alignment with the sheet indicia of the second sheet with the second sheet in the viewing position.

36. The apparatus of claim 33 wherein the front sheet and the back sheet are sealed together along at least one edge and folded along another edge.

37. The apparatus of claim 33 wherein the front sheet and the back sheet are sealed together along at least one edge.

38. The apparatus of claim 33 wherein the front sheet and the back sheet are folded together along at least one edge.

39. The apparatus of claim 33 wherein the front sheet is a transparent sheet.

40. An index divider system, comprising:

a first sheet having a plurality of first sheet indicia printed thereon;

a second sheet having a plurality of second sheet indicia printed thereon;

a sheet protector assembly having a front sheet, a back sheet, a top opening and a compartment defined between the sheets and communicating with the top opening; and with the first and second sheets in the compartment and with the second sheet in front of the first sheet, the second sheet allowing the first sheet indicia to be viewed therethrough and the front sheet allowing the first and second sheet indicia to be viewed therethrough.

41. The system of claim 40 wherein with the sheets disposed in the compartment, respective ones of the first and second sheet indicia are generally in alignment with one another.

42. The system of claim 40 wherein the front sheet comprises a transparent sheet.

43. The system of claim 40 wherein the front sheet comprises an opaque or translucent sheet having a window through which the first and second sheet indicia are viewable.

44. The system of claim 40 wherein the assembly has binder holes.

45. The system of claim 44 wherein the first and second sheets have binder holes which are aligned with the binder holes of the assembly when the sheets are in the compartment.

46. The system of claim 40 wherein the second sheet is a transparent sheet.

47. The system of claim 40 further comprising a set of dividers having staggered tabs, the set being positionable with the assembly such that with the first and second sheets in the compartment, the first and second indicia are aligned with respective ones of the staggered tabs.

48. The system of claim 47 wherein the dividers have divider binder holes and the assembly has binder holes alignable with the divider binder holes.

49. A sheet holding and viewing apparatus, comprising:

a sheet protector pocket having a front sheet, a back sheet secured to the front sheet and defining a compartment with the front sheet, an opening communicating with the compartment, and a plurality of binder holes;

the front sheet comprising a transparent sheet; and the front sheet including preprinted indicia positioned to at least in part define a framing around at least one of indicia or image on a sheet, which is inserted in through the opening and positioned in the compartment.

50. The apparatus of claim 49 further comprising a frame holder for holding the sheet in position in the compartment.

51. The apparatus of claim 49 wherein the opening defines a first opening, the compartment defines a first compartment, the sheet defines a first sheet, and the sheet protector pocket further includes a second compartment and a second opening through which a second sheet having at least one of indicia or image can be inserted into the second compartment for viewing through the front sheet.

52. The apparatus of claim 51 wherein the front sheet includes preprinted indicia positioned to at least in part define a framing or decorative element around the at least one of indicia or image on the second sheet in the second compartment.

53. A sheet holding and viewing apparatus, comprising:

a sheet protector pocket having a front sheet, a back sheet connected to the front sheet and defining a compartment with the front sheet, and an opening communicating with the compartment;

the front sheet comprising an at least substantially transparent sheet; and the front sheet including preprinted indicia positioned to complement at least one of indicia or image on a sheet, which is inserted in through the opening and positioned in the compartment for viewing through the front sheet.

54. The apparatus of claim 53 wherein the sheet pocket protector includes a plurality of binder holes.

55. The apparatus of claim 53 wherein the sheet pocket protector includes an index tab extending out from an edge thereof.

56. The apparatus of claim 53 wherein the preprinted indicia identifies or labels at least in part the at least one of indicia or image on the sheet.

57. The apparatus of claim 53 wherein the at least one of indicia or image comprises printed matter.

58. An organization system, comprising:

a first sheet holding and viewing apparatus including: a first sheet protector pocket having a first front sheet, a first back sheet, an outwardly extending first tab and a first opening, the first pocket being adapted to receive therein and into a viewing position through the opening a first sheet having a plurality of sheet indicia thereon, the first front sheet allowing the sheet indicia to be viewed therethrough with the first sheet disposed in the first pocket, and the first front sheet having front sheet indicia thereon associated with and generally in alignment with the sheet indicia with the first sheet in the viewing position, and with the first sheet in the viewing position at least one of the sheet indicia and one of the first front sheet indicia being aligned with the first tab;

a second sheet holding and viewing apparatus including: a second sheet protector pocket having a second front sheet, a second back sheet, an outwardly extending second tab and a second opening, the second pocket being adapted to receive therein and into a viewing position through the second opening a second sheet having a plurality of sheet indicia thereon, the second front sheet allowing the sheet indicia to be viewed therethrough with the second sheet disposed in the second pocket, and the second front sheet having front sheet indicia thereon associated with and generally in alignment with the sheet indicia with the second sheet in the viewing position, with the second sheet in the viewing position at least one of the sheet indicia and one of the second front sheet indicia being aligned with the second tab, the second tab being staggered with respect to the first tab;

a tabless third sheet holding and viewing apparatus disposed between the first and second apparatuses; and a binding system binding the first, second and third sheet holding and viewing apparatuses together.

59. A method of organizing tab dividers, comprising:

providing a set of tab dividers having staggered tabs;

providing a sheet protector having first indicia thereon, each associated with a different one of the tab dividers and positioned to be aligned with a respective one of the tabs when the protector is aligned with the tab dividers, the sheet protector having a compartment and a front sheet;

providing a sheet having second indicia each associated with a different one of the tab dividers; and inserting the sheet into the compartment into a viewing position such that the second indicia is viewable through the front sheet and the second indicia are each aligned with a respective one of the tabs.

60. The method of claim 59 wherein the providing a sheet includes a user designing the second indicia using software and printing the second indicia using a printer or copier.

61. The method of claim 60 wherein the second indicia is applied using a printer, a copier, a typewriter, an applied label or handwriting.

62. The method of claim 60 wherein the second indicia are associated with respective ones of the first indicia and in substantial alignment therewith when the sheet is in the viewing position.

63. The method of claim 59 wherein the tab dividers and the sheet protector include binder holes, and further comprising inserting the tab dividers and the sheet protector into a ring binder.

64. The method of claim 59 wherein the sheet protector and the sheet include binder holes which are aligned when the sheet is in the viewing position.

65. The method of claim 64 further comprising before the inserting, punching the binder holes in the sheet.

66. The method of claim 59 further comprising before the inserting, removing the sheet protector and the dividers from retail packaging.

67. The method of claim 59 wherein the sheet defines a first sheet, and further comprising providing a second sheet having third indicia, which is different from the second indicia, each of the third indicia associated with a different one of the tab dividers, and after the inserting, inserting the second sheet into the compartment into a viewing position such that the third indicia is viewable through the front sheet and the third indicia are each alignable with a respective one of the tabs with the sheet protector in position relative to the set of tab dividers.

68. The method of claim 59 further comprising providing insert sheets, and binding the tab dividers, insert sheets and sheet protector together.

69. A method of organizing tab dividers, comprising:

providing a set of tab dividers having staggered tabs;

providing a sheet protector, the sheet protector having a compartment and a front sheet;

providing a first sheet having first sheet indicia, each associated with a respective one of the tab dividers;

providing a second sheet having second sheet indicia, each associated with a respective one of the tab dividers; and inserting the first and second sheets into the compartment into a viewing position with the second sheet in front of the first sheet such that the first indicia are viewable through the first sheet and the front sheet and the second indicia are viewable through the front sheet.

70. The method of claim 69 further comprising inserting the tab dividers and the sheet protector in a ring binder.

71. The method of claim 69 wherein the front sheet comprises a transparent sheet.

72. The method of claim 69 wherein the second sheet comprises a transparent sheet.

73. The method of claim 69 wherein the first sheet providing includes designing the first sheet indicia on a computer and passing a sheet through a printer or copier so that the first sheet indicia is printed thereon.

74. The method of claim 73 wherein the second sheet providing includes designing the second sheet indicia on a computer and passing a sheet through a printer or copier so that the second sheet indicia is printed thereon.

75. An assembly comprising:

a front sheet and a back sheet connected to one another along at least a side edge and a bottom edge and forming a sheet protector pocket having a top opening;

the pocket adapted to be in a received position with a sheet having a plurality of longitudinally-aligned sheet indicia thereon removably positioned in the pocket between the front and back sheets;

the pocket adapted to be in an assembled position assembled with a set of tabbed dividers, tabs of the dividers being in staggered relation;

the front sheet having window indicia thereon defining a plurality of windows;

the windows are longitudinally aligned relative to one another on the front sheet;

the windows are positioned such that a separate one of the sheet indicia is positioned in each one of the windows and visible therethrough with the pocket in the received position; and each of the windows is laterally aligned with a corresponding one of the tabs when the pocket is in the assembled position.

76. The assembly of claim 75 including:

the front sheet having identifier indicia thereon defining a plurality of tab identifiers;

each of the tab identifiers is laterally aligned with a respective one of the windows; and each of the tab identifiers is laterally aligned with a corresponding one of the tabs when the pocket is in the assembled position.

77. The assembly of claim 75 wherein the tab identifiers comprise alpha or numeric symbols.

78. The assembly of claim 76 wherein the sheet indicia and the tab identifiers both comprise alpha descriptors.

79. The assembly of claim 76 wherein the tab identifiers each comprise a differently colored patch.

80. The assembly of claim 76 wherein the front sheet is a transparent sheet and the window indicia and the identifier indicia are printed on the transparent sheet.

81. The assembly of claim 75 wherein the side edge is a right side edge.

82. The assembly of claim 75 wherein the front sheet is transparent.

83. The assembly of claim 75 wherein the dividers and the pocket have binder holes which are aligned with one another when the pocket is in the assembled position and the dividers and the pocket are in a binding system.

84. The assembly of claim 83 wherein the binding system is a three-ring binder notebook.

85. The assembly of claim 75 wherein the sheet indicia is user-designed and user-printed.

86. The assembly of claim 75 wherein the top opening extends down along a left side edge of the pocket.

87. The assembly of claim 75 wherein the front and back sheets are formed from two separate webs that are welded together.

88. The assembly of claim 75 wherein the front and back sheets are formed from a single web that is folded onto itself to form the side edge.

89. The assembly of claim 75 wherein the front and back sheets comprise plastic film.

90. The assembly of claim 75 wherein the sheet indicia comprise user hand-printed indicia.

91. The assembly of claim 75 wherein the sheet indicia are applied to the sheet using a printer, a copier, a typewriter or by hand.

92. The assembly of claim 75 wherein the sheet indicia comprise manufacturer preprinted indicia.

93. The assembly of claim 75 wherein each of the dividers, the sheet and the pocket has binder holes.

94. The assembly of claim 93 wherein a storage area defined by the pocket has slightly larger width and length dimensions than those of the sheet to maintain the sheet therein when the pocket is in the received position, and the binder holes of the sheet and of the pocket are aligned when the pocket is in the received position.

95. The assembly of claim 75 wherein the pocket includes a binder strip secured to at least one of the front and back sheets and through which binder holes of the pocket pass.

96. The assembly of claim 75 wherein the sheet comprises a paper sheet.

97. The assembly of claim 75 wherein the dividers comprise opaque paper dividers.

98. The assembly of claim 75 wherein when the pocket is in the assembled position, sheet inserts are positioned between the dividers of the set of tabbed dividers.

99. The assembly of claim 75 wherein the pocket includes a binder strip having binder holes and extending out from the front and back sheets, and the dividers have binder holes which are aligned, with the binder strip binder holes when the pocket is in the assembled position.

100. A tabbed divider system, comprising:

a front sheet and a back sheet connected to one another along at least a side edge and a bottom edge and forming a sheet protector pocket having a top opening;

the pocket adapted to be in a received position with a sheet having a plurality of longitudinally-aligned sheet indicia thereon removably positioned in the pocket between the front and back sheets;

a set of tabbed dividers assembled with the sheet protector pocket, with tabs of the dividers in staggered relation;

the front sheet having window indicia thereon defining a plurality of windows;

the windows are longitudinally aligned relative to one another;

the windows are positioned such that a separate one of the sheet indicia is positioned in each one of the windows and visible therethrough with the pocket in the received position; and each of the windows is laterally aligned with a corresponding one of the tabs of the tabbed dividers.

101. The system of claim 100 including:

the front sheet having identifier indicia thereon defining a plurality of tab identifiers;

each of the identifiers is laterally aligned with a respective one of the windows; and each of the identifiers is laterally aligned with a corresponding one of the tabs of the tabbed dividers.

102. The system of claim 101 wherein the tab identifiers comprise alpha or numeric symbols.

103. The system of claim 101 wherein the sheet indicia and the tab identifiers both comprise alpha descriptors.

104. The system of claim 101 wherein the tab identifiers each comprise a differently colored patch.

105. The system of claim 101 wherein the front sheet is a transparent sheet and the window indicia and the identifier indicia are printed on the transparent sheet.

106. The system of claim 100 wherein the side edge is a right side edge.

107. The system of claim 100 wherein the front sheet is transparent.

108. The system of claim 100 wherein the dividers and the pocket have binder holes which are aligned with one another when the pocket is in the assembled position and the dividers and the pocket are in a binding system.

109. The system of claim 100 wherein the binding system is a three-ring binder notebook.

110. The system of claim 100 wherein the sheet indicia is user-designed and user-printed.

111. The system of claim 100 wherein the top opening extends down a left side edge of the pocket.

112. The system of claim 100 wherein the front and back sheets comprise two separate webs that are welded together.

113. The system of claim 100 wherein the front and back sheets comprise a single web that is folded onto itself to form the side edge.

114. The system of claim 100 wherein the front and back sheets comprise plastic film.

115. The system of claim 100 wherein the sheet indicia comprise user hand-printed indicia.

116. The system of claim 100 wherein the sheet indicia are applied to the sheet using a printer, a copier, a typewriter or by hand.

117. The system of claim 100 wherein the sheet indicia comprise manufacturer preprinted indicia.

118. The system of claim 100 wherein each of the dividers, the sheet and the pocket has binder holes.

119. The system of claim 118 wherein a storage area defined by the pocket has slightly larger width and length dimensions than those of the sheet to maintain the sheet therein when the pocket is in the received position, and the binder holes of the sheet and the pocket are aligned when the pocket is in the received position.

120. The system of claim 100 wherein the pocket includes a binder strip secured to at least one of the front and back sheets and through which binder holes of the pocket pass.

121. The system of claim 100 wherein the sheet comprises a paper sheet.

122. The system of claim 100 wherein the dividers comprise opaque dividers.

123. The system of claim 100 further comprising sheet inserts positioned between the dividers of the set of tabbed dividers.

124. The system of claim 100 wherein the pocket includes a binder strip having binder holes and extending out from the front and back sheets and aligned with binder holes of the dividers.

125. The system of claim 100 further comprising a package holding the pocket and the set of dividers.

126. The system of claim 125 wherein the package comprises a plastic retail package.

127. The system of claim 125 further comprising an instruction sheet disposed in the package and removable therefrom by a user.

128. The system of claim 125 wherein the sheet is disposed in the package and removable therefrom for application of the sheet indicia thereon by a user and insertion in the pocket.

129. A method of organizing tab dividers, comprising:

providing a set of tab dividers having staggered tabs;

providing a sheet protector pocket including a front sheet and a back sheet connected to one another along at least a side edge and a bottom edge;

the pocket having a top opening;

the pocket having window indicia defining a plurality of longitudinally-aligned windows on the front sheet;

providing a sheet having a plurality of longitudinally-aligned sheet indicia, each associated with a different one of the tab dividers; and inserting the sheet into the pocket through the open top into a viewing position such that each of the sheet indicia is viewable through the front sheet through respective ones of the windows and the sheet indicia are each aligned with a respective one of the tabs when the pocket is assembled with the tab dividers.

130. The method of claim 129 including:

the pocket having identifier indicia defining a plurality of tab identifiers, each associated with a different one of the tab dividers and positioned to be aligned with a respective one of the tabs when the pocket is assembled with the tab dividers.

131. The method of claim 130 wherein the tab identifiers are longitudinally-aligned with respective ones of the windows.

132. The method of claim 130 wherein the sheet defines a first sheet, and further comprising providing a second sheet having sheet indicia, which is different from the sheet indicia of the first sheet, each of the sheet indicia of the second sheet associated with a different one of the tab dividers, and after the inserting, inserting the second sheet into the pocket into a viewing position such that each of the sheet indicia of the second page is viewable through the front sheet and the sheet indicia of the second sheet are each alignable with a respective one of the tabs with the pocket in position relative to the set of tab dividers.

133. The method of claim 129 wherein the providing a sheet includes a user designing the sheet indicia using software and printing the sheet indicia on the sheet using a printer or copier.

134. The method of claim 129 wherein the sheet indicia is applied using a printer, a copier, a typewriter, an applied label or handwriting.

135. The method of claim 129 wherein the tab dividers and the pocket include binder holes, and further comprising inserting the tab dividers and the pocket into a ring binder using the binder holes.

136. The method of claim 129 wherein the pocket and the sheet include binder holes which are aligned when the sheet is in the viewing position.

137. The method of claim 136 further comprising before the inserting, punching the binder holes in the sheet.

138. The method of claim 136 further comprising before the inserting, removing the pocket and the dividers from retail packaging.

139. The method of claim 129 further comprising providing insert sheets, and binding the tab dividers, insert sheets and pocket together.

* * * * *